US005344519A

United States Patent [19]

Galchefski et al.

[11] Patent Number: 5,344,519

[45] Date of Patent: Sep. 6, 1994

[54] APPARATUS FOR APPLYING LABELS ONTO SMALL CYLINDRICAL ARTICLES HAVING IMPROVED VACUUM AND AIR PRESSURE PORTING FOR LABEL TRANSPORT DRUM

[75] Inventors: John M. Galchefski, Larksville, Pa.; Ian Westbury, Turlock, Calif.

[73] Assignee: CMS Gilbreth Packaging Systems, Trevose, Pa.

[21] Appl. No.: 62,314

[22] Filed: May 14, 1993

Related U.S. Application Data

[63] Continuation-in-part of Ser. No. 906,573, Jun. 30, 1992.

[51] Int. Cl.[5] ..... B65C 9/00

[52] U.S. Cl. ..... 156/456; 156/444; 156/446; 156/521; 156/568; 156/DIG. 38; 271/276; 271/309

[58] Field of Search ..... 156/456, 444, 446, 447, 156/475, 566, 567, 568, 521, DIG. 13, DIG. 31, DIG. 38; 271/112, 276, 309, 195, 196

[56] References Cited

U.S. PATENT DOCUMENTS

| | | | |
|---|---|---|---|
| 2,703,660 | 3/1955 | Von Hofe et al. | 216/55 |
| 3,235,433 | 2/1966 | Cvacho et al. | 156/229 |
| 3,577,293 | 5/1971 | Ritterhoff | 156/187 X |
| 3,604,584 | 9/1971 | Shank, Jr. | 215/12 R |
| 3,659,394 | 5/1972 | Hartleib et al. | 53/33 |
| 3,765,991 | 10/1973 | Hoffmann | 156/521 |
| 3,834,963 | 9/1974 | Hoffman | 156/256 |
| 3,878,960 | 4/1975 | Jonsson et al. | 215/12 R |
| 4,029,537 | 6/1977 | Kish | 271/276 X |
| 4,108,709 | 8/1978 | Hoffmann | 156/446 |
| 4,108,710 | 8/1978 | Hoffmann | 156/450 |
| 4,108,711 | 8/1978 | Hoffmann | 156/497 |
| 4,124,433 | 11/1978 | Herdzina et al. | 156/456 |
| 4,207,832 | 6/1980 | Bowman et al. | 118/212 |
| 4,242,167 | 12/1980 | Hoffmann | 156/357 |
| 4,323,416 | 4/1982 | Malthouse et al. | 156/521 |
| 4,336,095 | 6/1982 | Hoffmann | 156/361 |
| 4,366,016 | 12/1982 | Golden, Jr. | 156/218 |
| 4,406,721 | 9/1983 | Hoffmann | 156/86 |
| 4,416,714 | 11/1983 | Hoffmann | 156/86 |
| 4,425,866 | 1/1984 | Hoffmann | 118/58 |
| 4,443,285 | 4/1984 | Roth et al. | 156/215 |

(List continued on next page.)

FOREIGN PATENT DOCUMENTS

| | | |
|---|---|---|
| 1012906 | 6/1977 | Canada . |
| 0063845 | 3/1982 | European Pat. Off. . |
| 0377384 | 11/1990 | European Pat. Off. . |
| 1464316 | 12/1966 | France . |
| 1106653 | 3/1968 | United Kingdom . |

*Primary Examiner*—David A. Simmons
*Assistant Examiner*—James J. Engel, Jr.

[57] ABSTRACT

An apparatus for applying thin film polymer labels onto small cylindrical articles includes a label transport drum that is constructed for aiding the transfer of a label onto a cylindrical article. The apparatus includes a label transport drum having a cylindrically configured hub and cylindrical drum mounted on the hub for rotation thereabout. The drum has an outer surface on which labels are fed while the drum is rotated about the hub. A first radially extending, slotted vacuum manifold defines a label retention area and extends circumferentially around a substantial portion of the circumference of the hub. A first radially extending slotted pressure manifold is aligned circumferentially after the slotted vacuum manifold at an article wrapping position. A valve port, circumferentially aligned with the vacuum and pressure manifolds is positioned on the inner surface of the drum and communicates with the area on the drum surface where the leading edge of the label lies. As the drum rotates, the valve port aligns with the vacuum manifold and draws a vacuum onto the label to retain the label onto the drum. As the drum rotates further the valve port aligns with the pressure manifold to blow air onto the leading edge of the label to force the label outwardly from the drum surface onto an article thereat to aid in label transfer. A second vacuum manifold and valve port draw vacuum onto the label to retain the label on the drum surface past the article wrapping position if an article is not wrapped. The label is blown from the drum surface if an article misfeeds.

23 Claims, 14 Drawing Sheets

U.S. PATENT DOCUMENTS

| | | | |
|---|---|---|---|
| 4,447,280 | 5/1984 | Malthouse | 156/85 |
| 4,496,409 | 1/1985 | Kontz | 156/85 |
| 4,500,386 | 2/1985 | Hoffman | 156/449 |
| 4,526,645 | 7/1985 | Malthouse et al. | 156/350 |
| 4,544,431 | 10/1985 | King | 156/256 |
| 4,545,832 | 10/1985 | Hoffmann | 156/86 |
| 4,561,928 | 12/1985 | Malthouse | 156/497 |
| 4,574,020 | 3/1986 | Fosnaught | 156/80 |
| 4,604,154 | 8/1986 | Fosnaught | 156/264 |
| 4,632,721 | 12/1986 | Hoffmann et al. | 156/458 |
| 4,662,925 | 5/1987 | Thimons et al. | 65/104 |
| 4,662,965 | 5/1987 | DiFrank et al. | 156/578 X |
| 4,671,836 | 6/1987 | Fumei | 156/215 |
| 4,686,931 | 8/1987 | DiFrank | 118/50 |
| 4,693,210 | 9/1987 | DiFrank | 118/259 |
| 4,694,633 | 9/1987 | Fujio et al. | 53/49 |
| 4,704,173 | 11/1987 | Hoffman | 156/86 |
| 4,724,037 | 2/1988 | Olsen | 156/578 |
| 4,726,872 | 2/1988 | Olsen | 156/455 |
| 4,729,811 | 3/1988 | DiFrank | 156/449 |
| 4,735,668 | 4/1988 | Hoffmann | 156/215 |
| 4,749,428 | 6/1988 | Dickey | 156/215 |
| 4,761,200 | 8/1988 | Szeremeta | 156/448 |
| 4,772,354 | 9/1988 | Olsen et al. | 156/578 |
| 4,781,785 | 11/1988 | Szeremeta | 156/448 |
| 4,832,774 | 5/1989 | DiFrank et al. | 156/215 |
| 4,844,760 | 7/1989 | Dickey | 156/215 |
| 4,844,957 | 7/1989 | Hoffman | 428/34.7 |
| 4,923,557 | 5/1990 | Dickey | 156/86 |
| 4,931,122 | 6/1990 | Mitchell | 156/215 |
| 4,977,002 | 12/1990 | Hoffman | 428/34.7 |
| 4,984,413 | 1/1991 | Cosmo | 53/465 |
| 5,037,499 | 8/1991 | Bright et al. | 156/456 |
| 5,045,140 | 9/1991 | Dickey | 156/215 |
| 5,078,826 | 1/1992 | Rogall | 156/451 |
| 5,091,040 | 2/1992 | Otruba | 156/566 |
| 5,091,239 | 2/1992 | Przeworski et al. | 428/195 |
| 5,116,452 | 5/1992 | Eder | 156/566 |
| 5,122,216 | 6/1992 | Goodwin, III . | |

APPARATUS FOR APPLYING LABELS ONTO SMALL CYLINDRICAL ARTICLES HAVING IMPROVED VACUUM AND AIR PRESSURE PORTING FOR LABEL TRANSPORT DRUM

This application is a continuation-in-part application of U.S. patent application Ser. No. 07/906,573, filed Jun. 30, 1992, entitled "Apparatus And Method For Applying Labels Onto Small Cylindrical Articles", the disclosure which is incorporated herein by reference.

FIELD OF INVENTION

This invention relates to an apparatus for applying film labels onto small cylindrical articles and more particularly to an apparatus for applying small, high quality thin film labels onto small cylindrical articles such as dry cell batteries, while aiding the transfer of the label from a label transport drum onto the article by a vacuum and air pressure porting system within the label transport drum.

BACKGROUND OF THE INVENTION

In the copending parent patent application Ser. No. 07/906,573, filed Jun. 30, 1992, assigned to the present assignee, small articles such as dry cell batteries, lipstick containers, lip balm containers and the like are labeled with high quality, thin film polymeric labels. Labels are fed to a label transport drum, which includes a fixed, cylindrically configured hub, and a cylindrically configured drum rotatably mounted on the hub. In the copending, parent patent application, the drum has an outer surface on which labels are fed as a strip, and moved with the drum through a label drag area on the drum surface where the label strip is cut into labels of predetermined size.

As the cut label moves with the rotating drum surface, an adhesive is applied by a rotary pad print head onto the area adjacent the leading edge of the label and a predetermined amount of solvent is evenly applied onto the area adjacent the trailing edge of the label. The solvent dissolves partially the solvent treated area, forming a tacky area which later provides a solvent-seal bond. The label moves to a label wrapping position where the articles, such as dry cell batteries, are wrapped, securing first the leading edge to the article, followed by overlapping the trailing edge onto the leading edge so that the trailing edge solvent creates a solvent-seal bond. The apparatus provides for high quality cylindrical labeling of small articles such as dry cell batteries using thin film, polymeric labels, e.g., typically less than 0.0035 inches thickness.

As disclosed in the copending, parent application, beneficial labeling results are obtained to the label with a rotating, flexible wiper tip which holds the solvent captive on the edge of the tip, and wrapping the article on a substantially smooth drum surface. In one disclosed embodiment of the invention, the wiper tip includes a V-notch for holding captive the solvent. As the wiper tip moves at the same surface speed as the label transport drum, the wiper tip is deflected against the trailing edge of the label. The solvent is evenly transferred to the label.

In another embodiment, a flexible, tapered tip evenly applies solvent onto the label when the surface speed of the wiper tip is different from the surface speed of the label and drum. In one embodiment, the speed differential between the wiper tip and the label causes application of a "bead" of solvent at the point of departure of the wiper from the label, at a point adjacent to, but spaced from the trailing edge of the label. If the wiper is moving slower than the surface speed of the label transport drum, the solvent is wiped toward the trailing edge of the label. If the wiper is moving faster than the surface speed of the label transport drum, the solvent is wiped from the trailing edge forward. As the article rolls back over the solvent during wrapping, the weight of the article pushes the solvent evenly across the pretreated area on which the solvent was applied onto the trailing edge, thus in essence obtaining a more even solvent wipe along the trailing edge of the label.

This high quality labeling of small articles, such as dry cell batteries, requires precision labeling at high operating speeds. At such high operating speeds, it has been found that it is sometimes difficult to transfer the leading edge onto an article without assisting the label transfer from the drum surface. Additionally, if an article misfeeds into the article wrapping position, the label should be retained onto the drum surface, and moved past the article wrapping position into a position where the label can be removed from the surface of the drum. This type of control is difficult to achieve, i.e., 1) transferring the label onto an article at an article wrapping position, or 2) retaining the label past the article wrapping position during article misfeed, and then removing the label from the drum surface.

There are some mechanical apparatus using forked arms which engage grooves in the drum surface to remove a label after an article misfeeds. However, the mechanical arms are inefficient and do not always perform adequately, especially at higher operating speeds. It is more desirable to use vacuum and pressure manifolds, ports and simple non-moving parts between the rotating drum and stationary hub to provide an efficient vacuum and pressure porting system on the label transport drum which 1) initially retains the label to the drum, 2) assists label transfer to an article at the label wrapping position, and 3) removes the label from the drum at a position past the article wrapping position if proper article wrapping has not occurred.

SUMMARY OF THE INVENTION

It is therefore an object of the present invention to provide an apparatus for applying thin film polymer labels onto small cylindrical articles using a label transport drum which retains and moves the labels into a label wrapping position where the leading edge of the label is assisted into engagement with the article.

It is another object of the present invention to provide an apparatus for applying thin film polymer labels onto small cylindrical articles using a label transport drum which 1) retains the label to the drum, 2) assists the label transfer to an article at an article wrapping position, and 3) removes the label from the drum at a position past the article wrapping position if proper article wrapping has not occurred.

It is another object of the present invention to provide an apparatus for applying thin film polymer labels onto small cylindrical articles using a label transport drum having a fixed hub and rotating drum where vacuum retains the label as it moves into an article wrapping position and then air pressure is forced against the leading edge of the label to assist the leading edge of the label into engagement with an article positioned at the article wrapping position.

It is another object of the present invention to provide a label transport drum having a central, fixed hub and a rotatable drum mounted for rotation thereabout wherein vacuum and pressure can be drawn and forced onto labels positioned on the surface of the drum without using complex moving parts.

These and other objects and advantages of the invention are set forth in the description which follows and, in part, will be obvious from the description and advantages being realized and entertained by means of the instrumentation, facts, apparatus, systems, steps and procedures, as particularly pointed out in the specification.

In accordance with the present invention, labels formed from light weight, thin, polymeric sheet material are applied to small cylindrical articles such as dry cell batteries while obtaining well-defined, high quality seams between overlapping leading and trailing edges of the label without mismatching of the label. An adhesive is applied onto an area adjacent the leading edge of the label while the label is moving with the label transport drum. A predetermined amount of solvent is evenly applied onto the area adjacent the trailing edge of the label. The solvent dissolves a portion of the area adjacent the trailing edge to form a tacky area which later provides a solvent-seal bond.

The articles are conveyed in tangential spinning engagement with the label transport drum. As the drum rotates, the leading edge of the label engages an article and the adhesive retains the leading edge to the article. As the article rotates, the label wraps around the rotating article, and the trailing edge overlaps the leading edge so that the solvent secures the label in its wrapped condition to the article in a solvent-seal bond. The label is then heat shrunk about the article.

In accordance with the present invention, radially extending, slotted vacuum and pressure manifolds are positioned on the surface of the hub and communicate with respective ports on the label drum. A first vacuum manifold defines a label retention area where the label is retained on the surface of the drum and moves with the rotating drum. A first pressure manifold defines an article wrapping position after the label retention area. A label blow-off manifold defines a label blow-off area. In one embodiment, a second vacuum manifold provides for vacuum draw on the label past the article wrapping position when an article misfeeds or is not wrapped. Under these circumstances, the label moves into the blow-off area where it is blown from the surface of the drum.

In one embodiment valve ports are positioned on the inside surface of the drum and communicate via plenums to the outer surface of the drum where a label is positioned. As the drum rotates about the hub, the valve ports move over respective vacuum or pressure manifolds, acting similar to valves which are "on" when positioned over a manifold, but are "off" when positioned away from a manifold.

In the present invention, a first radially extending, slotted vacuum manifold defines a label retention area and extends circumferentially around a substantial portion of the circumference of the hub. A first radially extending slotted pressure manifold is aligned circumferentially after the slotted vacuum manifold in the direction of rotation of the drum at the article wrapping position. In one embodiment, a leading edge valve port is positioned on the inner surface of the drum and aligned circumferentially with the vacuum and pressure manifolds. The leading edge valve port is formed as a port opening which communicates with that area of the drum surface where the leading edge of the label is positioned.

The vacuum draw received from the vacuum manifold draws the leading edge of the label to the drum surface, retaining the label onto the surface of the drum as the label moves through the label retention area and the leading edge valve port is positioned over the vacuum manifold. As the drum rotates further, the valve port moves over the first pressure manifold at the article wrapping position and air from the manifold flows through the valve port to blow-off the leading edge of the label from the drum surface onto an article positioned thereat.

In a preferred embodiment, a second radially extending, slotted vacuum manifold is spaced off-set, i.e., side-by-side, with the first slotted vacuum and pressure manifolds and extends circumferentially past the label retention area and terminates at a position past the article wrapping position. A second valve port is positioned on the inner surface of the drum and aligned circumferentially with the second vacuum manifold. The second valve port communicates with the area on the drum surface where the trailing edge is positioned for receiving the vacuum draw from the second slotted manifold to retain the label onto the surface of the drum (1) in the label retention area and (2) past the article wrapping position if a label does not engage an article at the article wrapping position. In a preferred embodiment, the valve port also communicates with the area where the midportion of the label is positioned.

In a preferred embodiment, the valve ports are formed as bore openings extending radially outwardly through the drum to its surface. A label retaining insert plate covers the bore openings. A cut label is transferred from a cutter drum onto the plate. Orifices extend through the plate and communicate via plenums on the undersurface of the plate with the bore openings. The plenums are formed on the underside of the plate. Vacuum drawn through the bore openings, plenums and orifices retains the label onto the drum surface while it moves with the drum into the article wrapping position.

In another embodiment, the inner drum surface includes ports on the inside surface of the drum which communicate with separate plenums in the drum. Each plenum is open to the surface, but includes a covering orifice plate. A leading edge port, plenum and orifice plate communicate with the area where the leading edge of a label is positioned. Another midportion port, plenum and orifice plate communicate with the area where the midportion of a label is positioned and a trailing edge port, plenum and orifice plate communicate with the area where the trailing edge of a label is positioned. The trailing edge and midportion ports are circumferentially aligned with the second slotted vacuum manifold.

The vacuum draw in the second slotted vacuum manifold is maintained throughout drum rotation. During article labeling, as the leading edge of the label engages the article, the vacuum draw on the leading edge of the label is broken, allowing article wrapping even though vacuum is maintained in the second vacuum manifold. The rolling action of the article as the article is wrapped allows for continuous breaking of the vacuum seal between the label and the surface of the drum.

If an article misfeeds, the leading edge of the label does not engage an article, and the vacuum which retains the leading edge to the drum surface is not broken. Thus, the label does not roll upward onto the article. The label is retained to the drum surface by the vacuum drawn in the second manifold. The drum rotates further, moving the label to a label blow-off position.

In the preferred embodiment, first and second radially extending, slotted blow-off manifolds are circumferentially aligned and positioned after respective first and second radially extending slotted vacuum manifolds. The blow-off manifolds define the label blow-off area. When an article misfeeds, the label continues with the rotating drum into the label blow-off position, where valve ports align with the blow-off manifolds to force air outward against the label. As a result, the label is blown-off.

In accordance with another embodiment of the present invention, a third radially extending, slotted, label drag manifold is spaced offset (in the illustrated embodiment spaced between) the first and second slotted vacuum manifolds. This manifold is included when on-drum cutting of the label is desired. The third manifold extends circumferentially from a position where the first and second vacuum manifolds begin and extends a peripheral distance around the hub less than the distance the first vacuum manifold extends so as to define a label drag area.

In one embodiment, in the label drag area, the label material is first supplied as an uncut strip to the drum surface. Valve port means comprising a plurality of valve port hole openings on the inner surface of the drum, respective plenums and covering label drag orifice plates are aligned circumferentially with the drag manifold. The label drag orifice plates are positioned on the surface of the drum at the area before the leading edge portion of the label. A strip of label film is supplied to the surface of the drum and engages the label drag orifice plates. The label is retained to the drum surface by the vacuum drawn through the drag manifold and label drag orifice plates.

As the drum rotates, the film is fed at a slower rate than the rotating label transport drum, so that the film slips relative to the drum surface. An amount of film is fed corresponding to the length of one label. A knife blade positioned on a rotating drum is timed in synchronism with the drum so that it cuts the film where the indicia corresponding to the trailing edge of the film is positioned. The cut label then moves with the drum. When film is not fed, the film drags on the surface of the label transport drum until a new label is to be cut. The unwind mechanism again unwinds film for further cutting.

In this embodiment using "on drum" cutting, an anvil is positioned on the trailing edge orifice plate and acts as a cutting anvil to allow cutting of film fed to the drum surface, and thus allowing cutting at the area corresponding to where the trailing edge is desired.

DESCRIPTION OF THE DRAWINGS

The foregoing and other objects and advantages of the present invention will be appreciated more fully from the following description, with references to the accompanying drawings in which:

FIG. 1A is a schematic illustration of a label cutting assembly used for cutting labels on the drum;

FIG. 1B is a schematic illustration of a solvent wiper mounted for rotation adjacent the label transport drum;

FIG. 1C is an enlarged view of the static wiper assemblies;

DETAILED DESCRIPTION OF THE INVENTION

Figure 1:
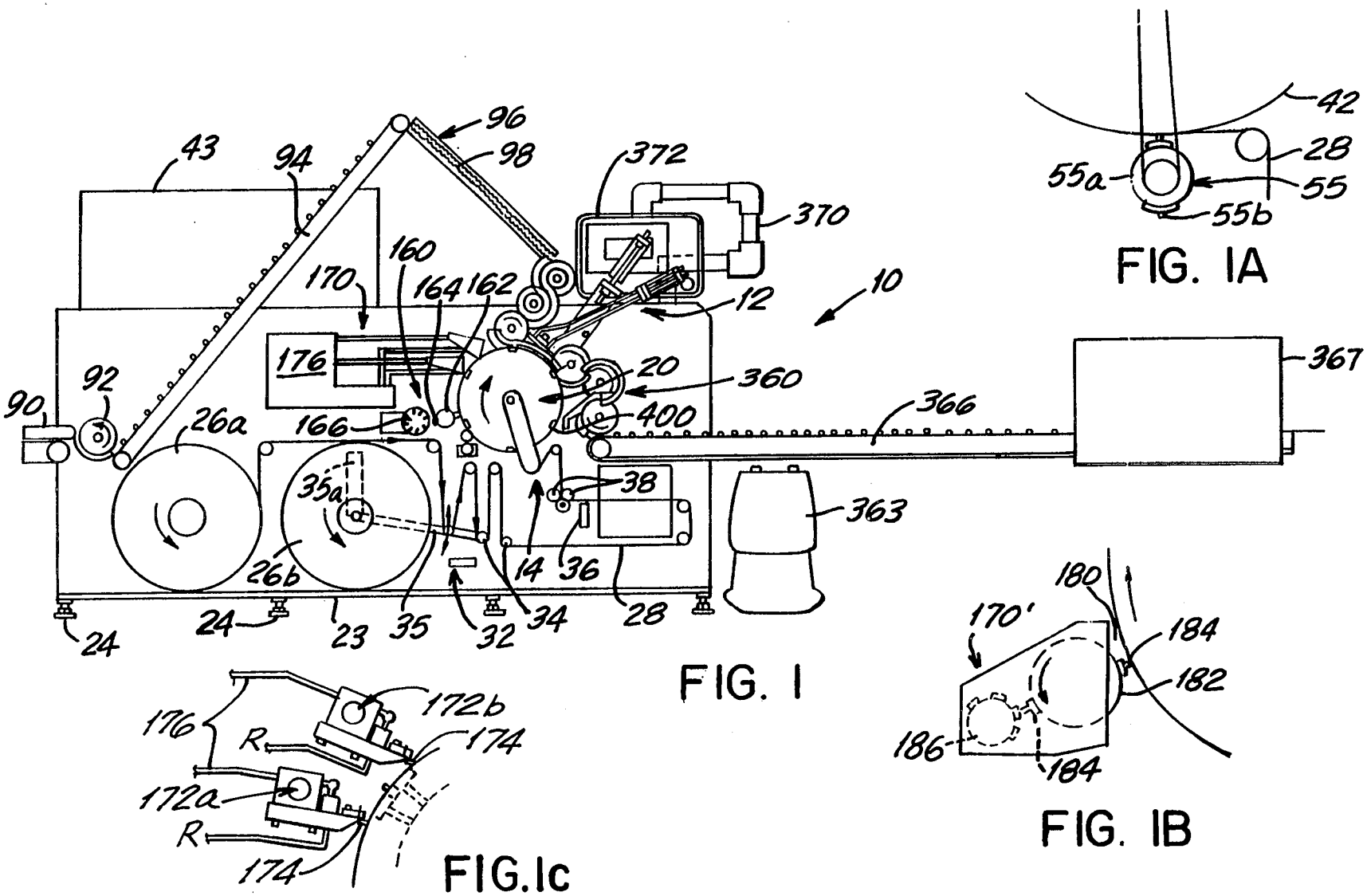
FIG. 1 is a schematic, side elevation view of the overall apparatus in accordance with the present invention that applies labels onto small cylindrical articles.

Referring now to FIG. 1, there is illustrated at 10 a schematic, overall illustration of the apparatus for applying high quality, thin film polymeric labels, to small cylindrical articles such as dry cell batteries while forming seams of high quality. Throughout this description the labels will be referred to by the letter "L." The apparatus 10 is suitable for high quality cylindrical labeling of small cylindrical articles such as dry cell batteries requiring thin labels with a thickness typically less than 0.0035 inches. Throughout the description and drawings, the small cylindrical articles to be labeled will be referred to as articles, and will be given the reference letter "A".

The apparatus 10 may be used for wrapping a label around a large variety of different small articles A requiring high quality labels, such as dry cell batteries, lip balm containers, lipstick tubes and other similar articles. Such high quality labeling requires end-to-end label alignment on the articles A without mismatching, so that different colored zones, lettering, and trade logos printed on the label are aligned correctly after the article is wrapped. A pressure applicator, also known as a "roll hand," indicated at 12, imparts a desired pressure onto selected areas of the sides and ends of the article during wrapping to ensure end-to-end alignment of the wrapped labels and prevent mismatching of the label during wrapping.

High quality labeling of smaller cylindrical articles such as dry cell batteries also requires precise control over the label as it moves into engagement with an article A. For example, in the illustrated embodiment of FIG. 1 and FIGS. 11 through 20, the label is initially fed as a strip to an "off drum" cutting assembly, indicated at 14. The cut label is then transferred to the surface of the label transport drum, indicated at 20. Vacuum drawn through ports on the drum and through orifices on label retaining plates retains the label to the drum surface. The label moves with the drum 20 into an article wrapping position, indicated at 22 (FIGS. 2, 11, 12, 17, and 18), where the leading edge of the label engages an article A that has been fed in tangential, spinning engagement with the surface of the high speed rotating drum.

This high speed drum rotation must be precisely timed with the feeding of the articles and the movement of the labels with the drum. The labels must be 1) retained to predetermined areas of the drum surface corresponding to where leading and trailing edges are to be positioned, 2) held thereto as the drum rotates into the article wrapping position 22, and then 3) precisely transferred to an article A at the article wrapping position 22. Because high speed rotation of the label transport drum 20 makes transfer of smaller labels onto small articles difficult, it has been found desirable that the leading edge of the label should be assisted onto the article to help ensure proper label transfer and alignment. Additionally if an article misfeeds and the label is not transferred, the label should be retained on the drum surface and moved to a label blow-off area past the article wrapping position 22 where the label can be blown from the drum surface so that it will not interfere with subsequent labels fed and wrapped onto articles.

The unique construction of the apparatus 10 and label transport drum 20 of the present invention provides proper control over label retention, movement, leading edge transfer, and blow-off necessary to ensure high quality labeling of small cylindrical articles such as dry cell batteries with thin film, polymer labels.

In accordance with the present invention, the apparatus 10 includes a frame 23 for supporting major components such as the label transport drum, adhesive and solvent applicators, and rolls of continuous label material. The frame 23 includes leg supports 24 for supporting the frame on the floor. In the illustrated embodiment, two rolls **26*a*, 26*b* of label material are supported for rotation on the frame 23. The frame 23** supports unwind drive motors and spindles (not shown) for unwinding the film and applying tension to the rolls during withdrawal of film. As one roll of film is completed, the film from the other roll is fed while the spent roll is replaced.

Figure 12:
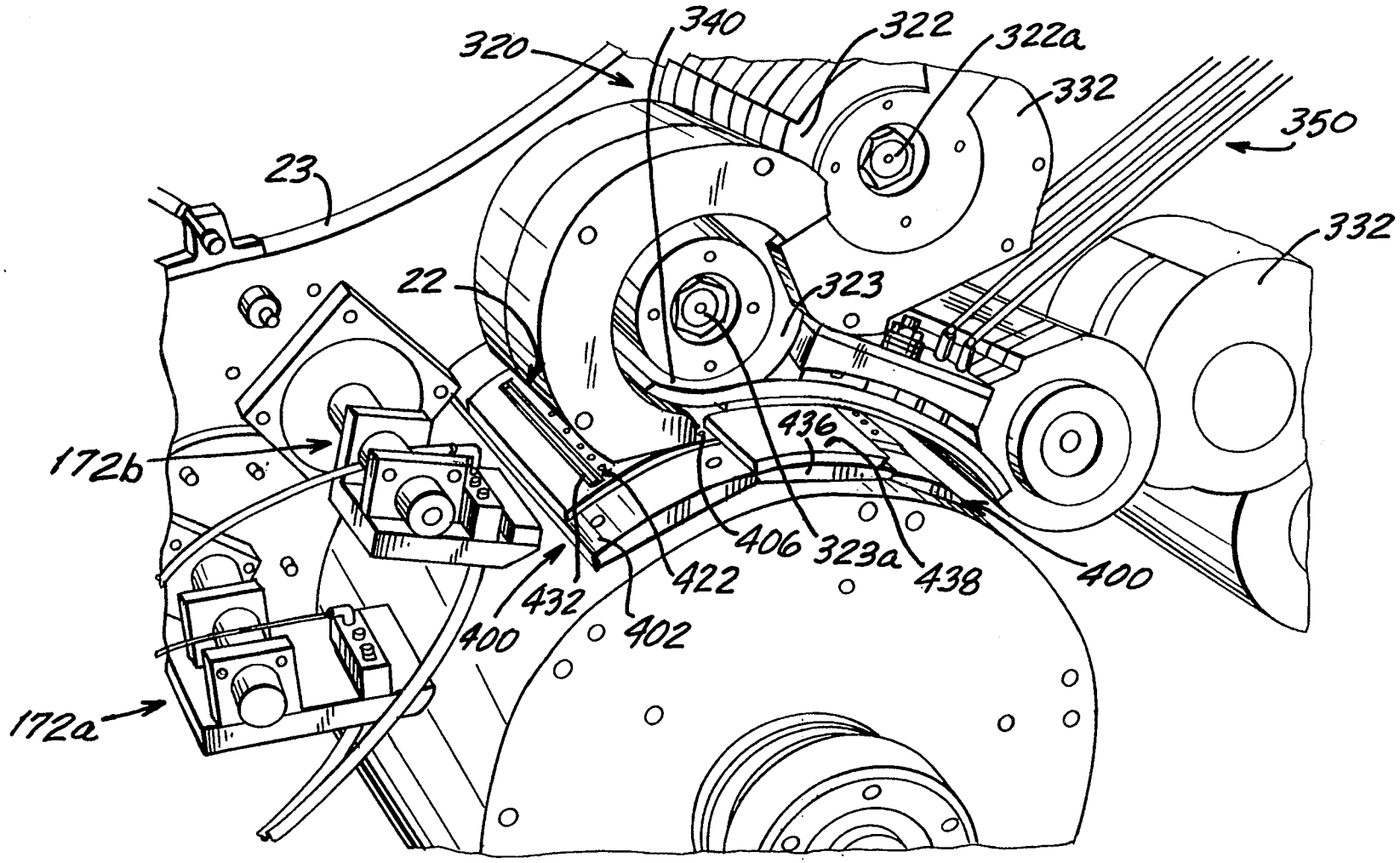
FIG. 12 is another pictorial view of the label transport drum and associated components showing in greater detail one label retaining insert plate and wiper assemblies.
Figure 13:
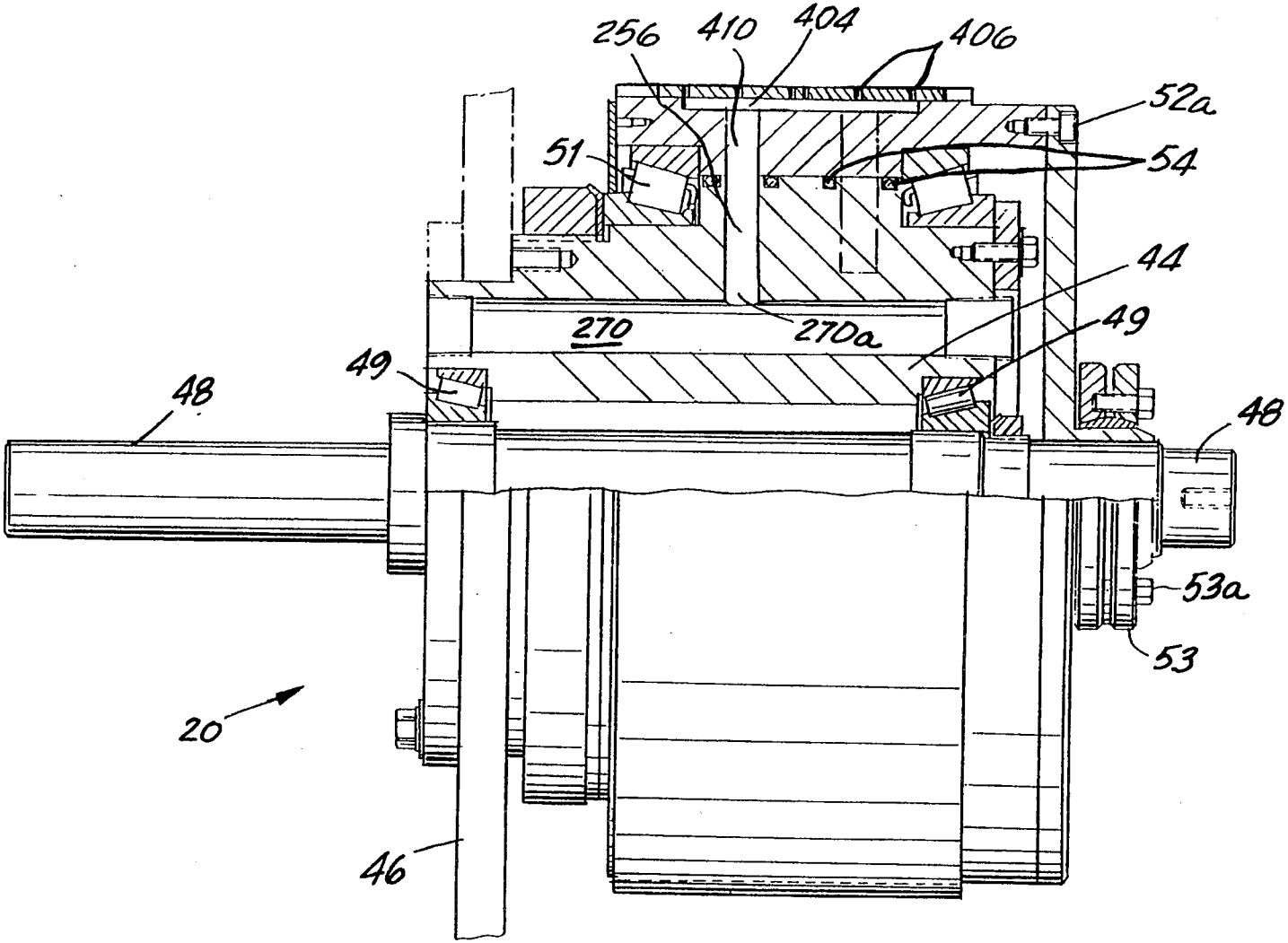
FIG. 13 is a partial sectional view of the label transport drum of the embodiment of FIG. 11 showing a hub construction in accordance with a second embodiment having only first and second vacuum manifolds.
Figure 18:
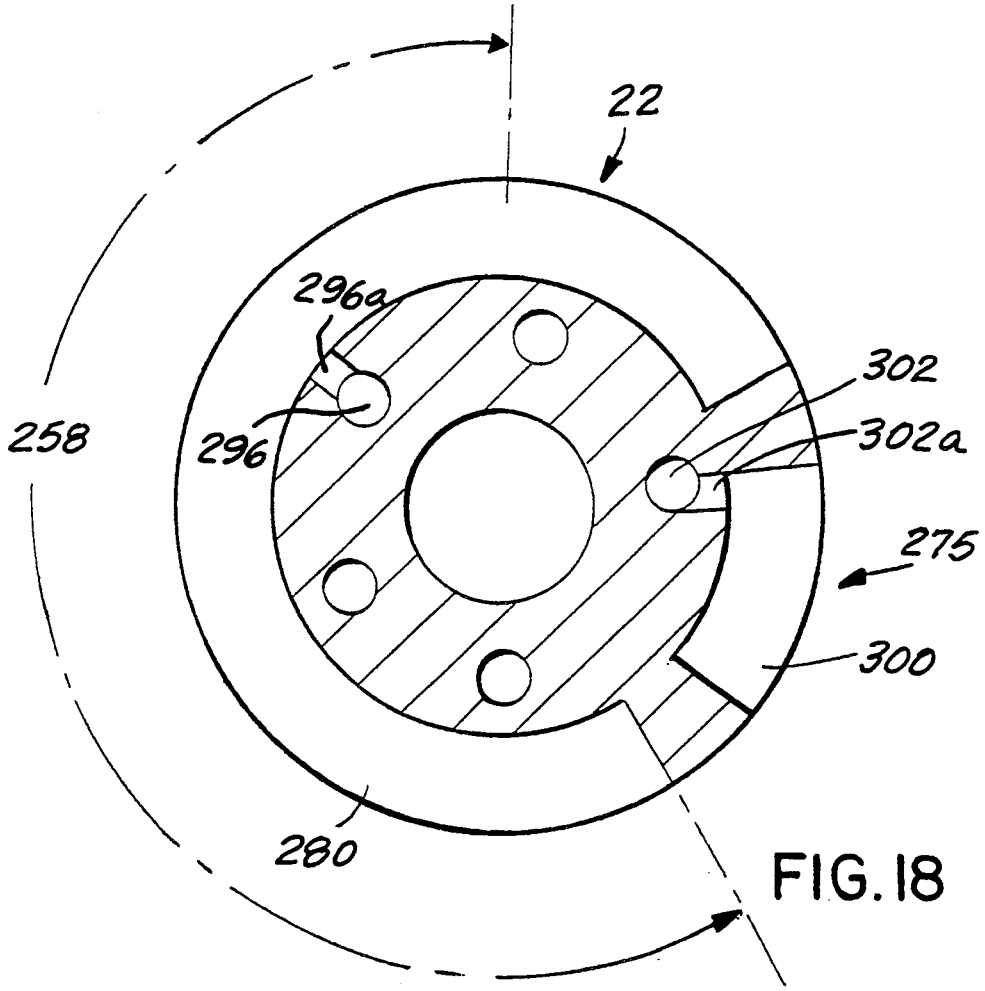
FIG. 18 is a sectional view of a second embodiment of the hub showing the second vacuum manifold and blow-off manifold.
Figure 19A:
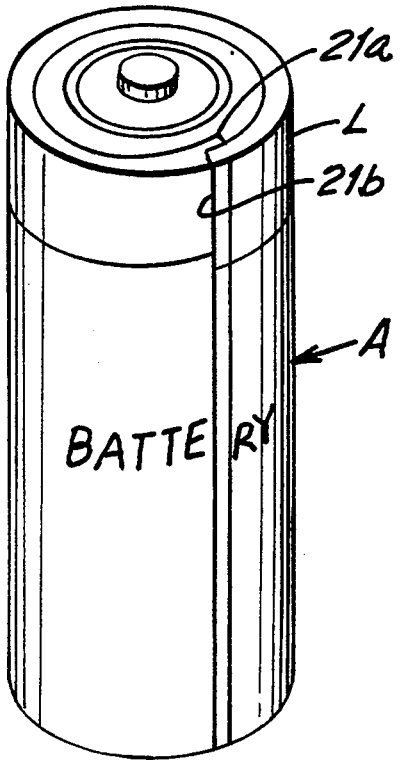
FIG. 19A is a pictorial view of a dry cell battery showing an improperly matched and aligned label applied thereto.
Figure 19B:
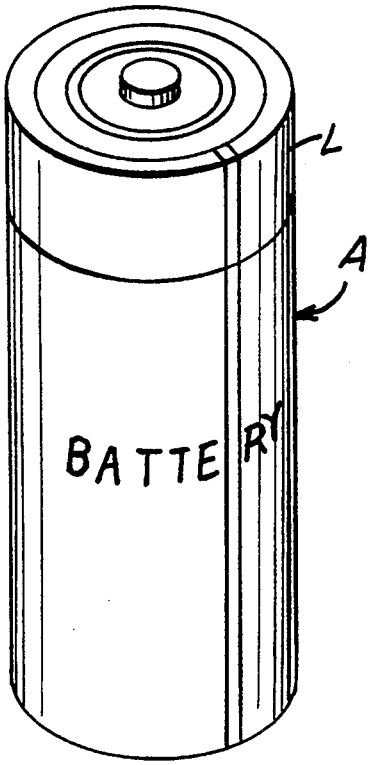
FIG. 19B is a pictorial view of a dry cell battery showing a properly matched and aligned label.

The label material is pre-printed with identifying indicia used on the label that is subsequently transferred to the article A (FIG. 12). Alternatively, a printing stamp or roller (not shown) may be positioned adjacent the label roll for printing directly onto the label material as it is withdrawn from the supply roll. The present illustrated apparatus 10 is designed for wrapping articles fed in parallel pairs to each other. In this embodiment, each strip of label material has first and second continuous columns of printed indicia. During labeling, the strip 28 is longitudinally slit by a conveniently positioned slitter knife 37, and then horizontally slit as will be explained later to form cut labels of predetermined size having leading and trailing edges **21*a*, 21*b* respectively (FIG. 18**A).

The label material is formed from a heat shrinkable film material. Examples of acceptable film materials include those formed from polyvinyl chloride, polyester, and polystyrene. The label material typically has a thickness under 0.0035 inches, a thickness corresponding to the thinner material thickness commonly used for labeling smaller cylindrical articles such as dry cell batteries, lip balm and other similar containers. Typically, the articles are about 1.75 inches in diameter or less corresponding to the diameter of a "D" size or smaller dry cell battery. Because of the demanding label and seam quality requirements necessary for labeling these types of small articles, the labels L heretofore have been pre-seamed on a continuous basis, and then applied as a sleeve to the article. With conventional sleeve technology where the sleeve is first formed on a mandrel and then transferred to an article, a typical article size ranged in size usually less than one inch diameter.

Figure 20:
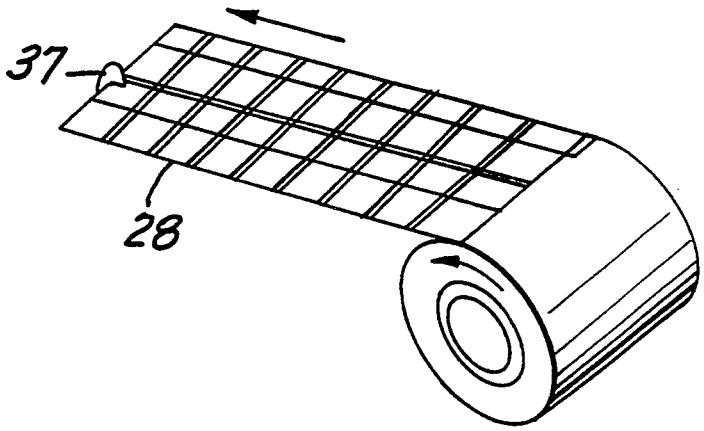
FIG. 20 is a pictorial view of a dual printed roll of label material used for labeling of dry cell batteries.

As indicated in FIG. 1, label material is fed as a strip 28 from the first supply roll **26*a* into a dancer roll assembly indicated generally at 32, having a plurality of individual dancer rolls 34 connected to a dancer arm 35. A potentiometer 35*a* is linked to the pivot of the dancer arm and controls the speed of the unwind motor. As the dancer arm is raised the potentiometer causes the unwind motor to rotate at a faster rate of speed to feed out more film to the dancer roll assembly. The strip 28 passes over a registration sensor 36, such as a fiber optic sensor, registering the amount of label strip 28 withdrawn from the supply rolls 26*a*, 26*b*. An automatic splicer 37 may be incorporated into the feed line to splice the strip into two strips (FIG. 20**).

The strip 28 passes through a pair of feed rolls 38 rotating upwardly and outwardly from each other to aid in pulling the strip through the dancer roll assembly 32. The feed rolls 38 are rubber coated and powered by a closed loop A.C. servomotor system. The servomotor system feeds film at a rate that is proportional to the rate of speed of the label transport drum. This is accomplished through a position feedback incremental encoder mounted on the label transport drum drive shaft. As the label transport drum rotates, the encoder feeds back positional information to a controller servomotor amplifier (not shown). The strip 28 passes over an idler roll and into the off-drum cutting assembly 14, where the film is cut into labels by means of a separate cutting drum and knife assembly (not shown in detail) where the film is cut into labels of desired size and then transferred onto the label transport drum 20.

The cut labels are small, typically no longer than about four inches, corresponding to the conventional dry cell batteries such as "AAA" through "D" size. For purposes of explanation, the batteries will be described with reference to a typical "AA" size dry cell battery. Drive motors and transmission impart the force necessary for rotating the drum 20 at a desired speed.

The illustrated figures show two embodiments of the present invention. FIGS. 2 through 10 illustrate a first embodiment where the film strip is fed onto the drum, then cut into labels. FIGS. 1 and 11–18 illustrate a more preferred, second embodiment where the film is cut off-drum by a separate cutter drum assembly, then transferred as cut labels onto the drum surface.

In accordance with the first embodiment, the label transport drum 20 includes an internal, cylindrically configured hub 44 secured directly to a front plate 46 (FIG. 3) of the machine frame 23. A drive shaft 48 passes through the hub 44 and is rotatably mounted by bearings 49 positioned in the hub. A cylindrically configured label drum 50 is mounted for rotation about the hub 44. The label drum 50 has bearings 51 which bear internally on the inside surface of the drum 50, and externally on the outer surface of the hub 44. The bearings allow the drum to rotate about the hub while the hub 44 remains stationary. A drive plate 52 is connected at one end to the label drum 50 by appropriate fastening means such as bolts **52*a*. The other end is connected to the drive shaft 48 by a commercial shrink disc coupling 53 which has fastening means such as bolts 53*a*** for fastening the couplers. The drum has a diameter of about seventeen inches and about a fifty four inch circumference. The described label transport drum components are formed from steel or other rigid material having high strength characteristics.

Seals 54 are positioned between the label drum 50 and the hub 44 and prevent leakage between the various vacuum and pressure slots as will be explained further. The preferred seals are an oil soaked felt which not only prevents leaks between various vacuum and pressure manifolds, but also lubricates the sliding fit between the label drum 50 and hub 44 to prevent seizure.

As shown in FIG. 1A, the cutting station for "on-drum" cutting includes a rotating knife assembly shown generally at 55. The knife assembly 55 may include a cutting wheel **55*a* having opposing cutting blades 55*b* that engage the strip, cutting the strip into labels. This embodiment of the label transport drum 20** is constructed for use with labels less than about four and a half inches long, corresponding to articles with about a one and a half inch diameter or less. With modifications to the drum, as will be explained later, the label transport drum can also be adapted for use with labels longer than about four and a half inches.

Figure 4:
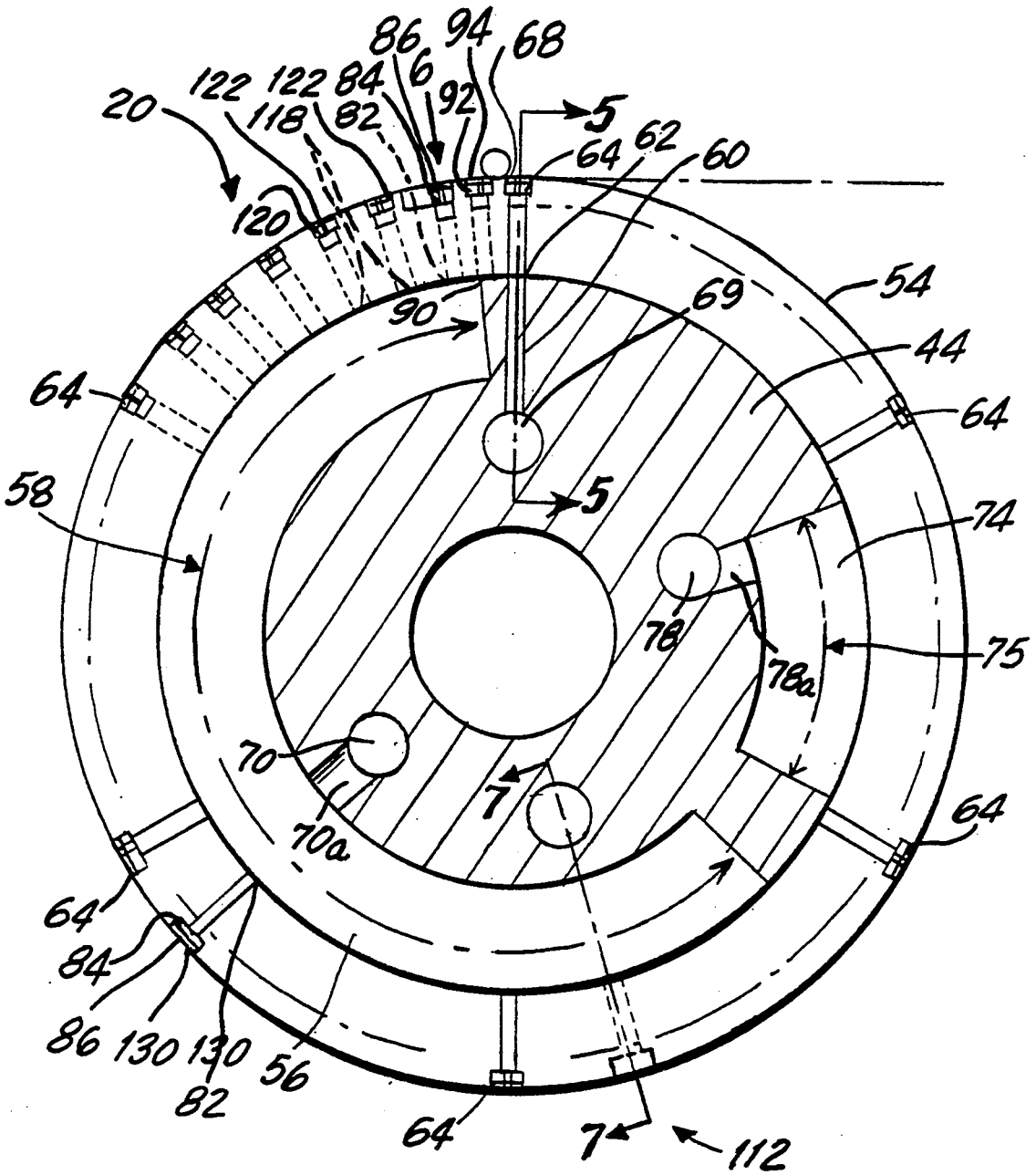
FIG. 4 is a partial, schematic sectional view taken along line 4—4 of FIG. 3 showing the leading edge valve port of the drum aligned with the first radially extending slotted pressure manifold.
Figure 8:
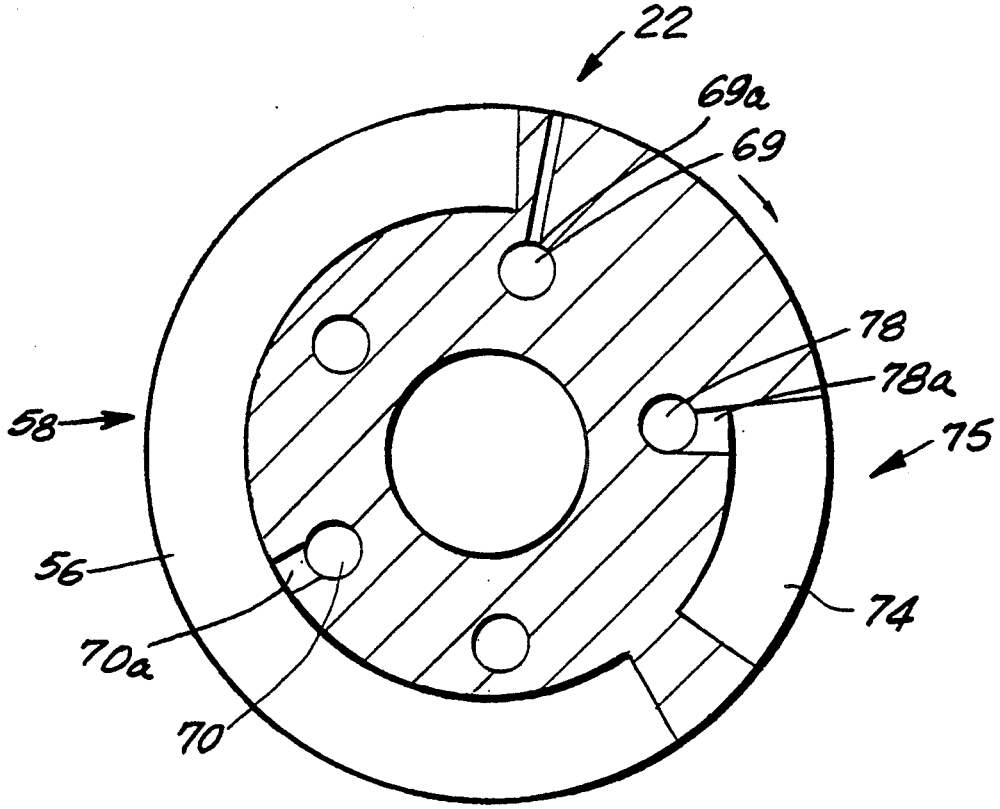
FIG. 8 is a sectional view of the hub showing the first vacuum and pressure manifolds and the blow-off manifold.

A first radially extending, slotted vacuum manifold 56 is formed on the outer circumferential, peripheral surface of the hub 44 and defines a label retention area, indicated generally by the arc 58 (FIGS. 4 and 8). This first vacuum manifold 56 extends circumferentially around a substantial portion of the circumference of the hub as shown in FIGS. 4 and 8. As illustrated, the vacuum manifold 56 extends about a 200° arc around the outer peripheral circumference of the hub surface. A first radially extending slotted pressure manifold 60 is aligned circumferentially with and about ten degrees (10°) past the end of the first vacuum manifold 56.

Figure 5:
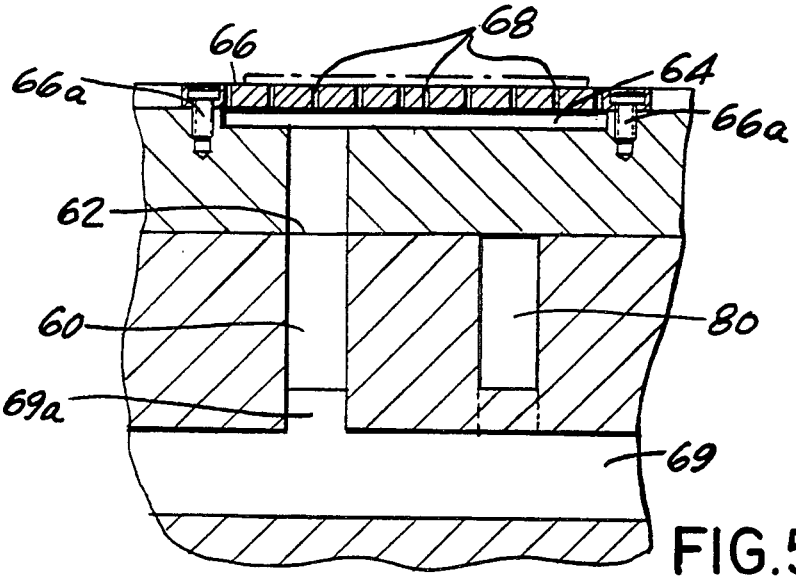
FIG. 5 is a sectional view of the drum and hub generally taken along the drum area defined by line 5—5 of FIG. 4 showing the first pressure manifold, and the leading edge plenum and valve port aligned with the pressure manifold for blowing the leading edge of a label.
Figure 6:
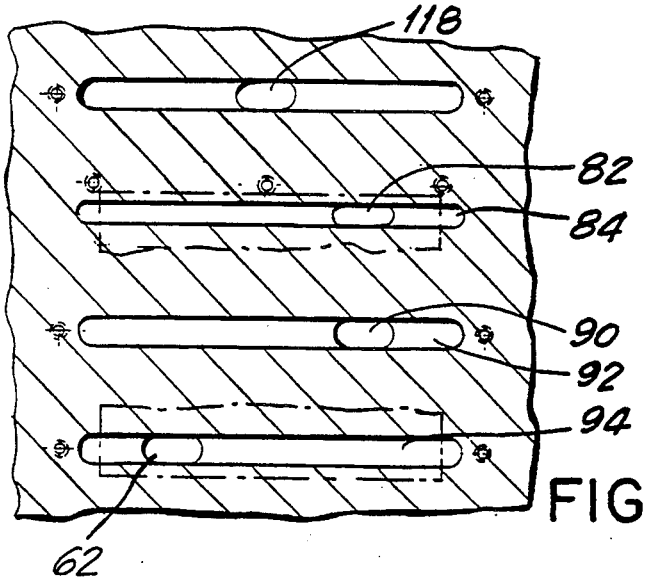
FIG. 6 is a plan view of the drum looking in the direction of arrow 6 of FIG. 4 showing the leading edge, midportion and trailing edge plenums.

A valve port 62, is positioned on the inner drum surface and aligned circumferentially with the first vacuum and pressure manifolds 56, 60 (FIGS. 5 and 6). The valve port 62 is formed as a hole extending into the label drum, and extends radially outward through the drum 50 and communicates with a substantially rectangular configured leading edge plenum 64 that has a length across the drum surface substantially equal to the length of a dual pair of labels fed side-by-side (FIG. 20), and a width typically about one-half inch.

The valve port 62 and leading edge plenum 64 are positioned in the area under the drum surface where the leading edge of a label is positioned after label cutting. As shown in FIG. 6, the plenum 64 is formed substantially open to the surface. An orifice plate 66 covers the leading edge plenum 64 and is secured to the drum surface over the plenum by fastening means such as bolts **66*a* (FIG. 5). The orifice plate 66 has a plurality of orifices 68 which extend through the plate 66 and allow the plenum 64 to communicate with the surface of the drum, i.e., where the leading edge of the label is positioned. A horizontal branch manifold 69 extends through the hub 44 and includes a manifold gate 69*a* extending between the branch manifold 69 and the slotted pressure manifold 60. A source of pressure is connected to the branch manifold 69. The horizontal branch manifold 69, manifold gate 69*a* and the pressure manifold 60 are pressurized by a source of pressure which can be located apart from the support frame. Additionally, the vacuum manifold 56 includes a horizontal vacuum manifold 70 and manifold gate 70*a*** communicating therewith. A source of vacuum (not shown) communicates with the horizontal manifold.

When the leading edge valve port 62 is positioned over the first vacuum manifold 56, the vacuum is drawn through the valve port 62, plenum 64 and orifices 68 to retain a label onto the drum surface. As the drum 54 rotates further relative to the hub, the valve port 62 moves out of engagement with the first vacuum manifold 56 and moves over and into engagement with the first pressure manifold 60 at the article wrapping position 22. Pressurized air flows through the horizontal pressure manifold 69, through the gate **69*a* and into the slotted pressure manifold 60. When the valve port 62 is aligned with the pressure manifold 60, high pressure air is forced through the valve port 62, plenum 64 and orifices 68 to blow outward the leading edge of the label onto an article positioned at the article wrapping position 22. As illustrated, the pressure manifold 60 is narrow. As a result, the narrow manifold 60 provides a narrow burst of high pressure air onto the leading edge of the label when the valve port is aligned over the manifold 60**.

Figure 7:
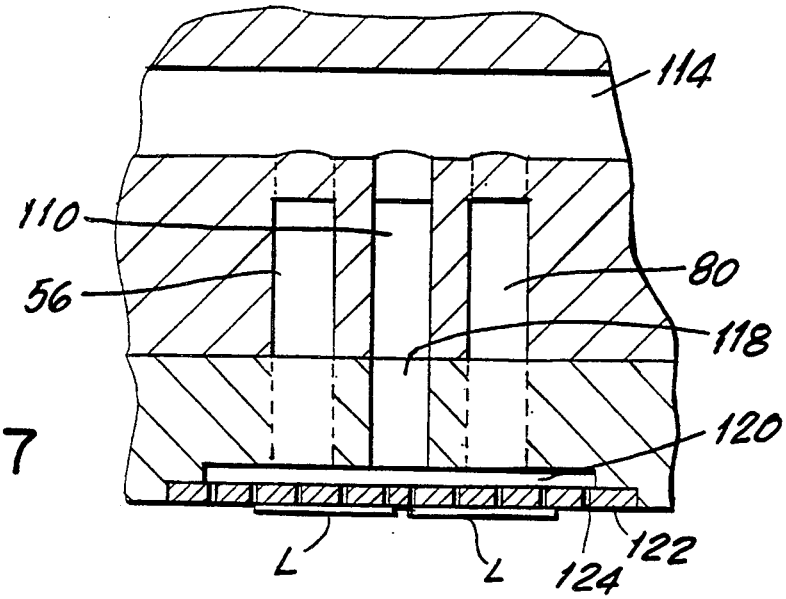
FIG. 7 is a sectional view of the drum and hub taken generally along the area defined by line 7—7 of FIG. 4 showing the label hold-down manifold.
Figure 10:
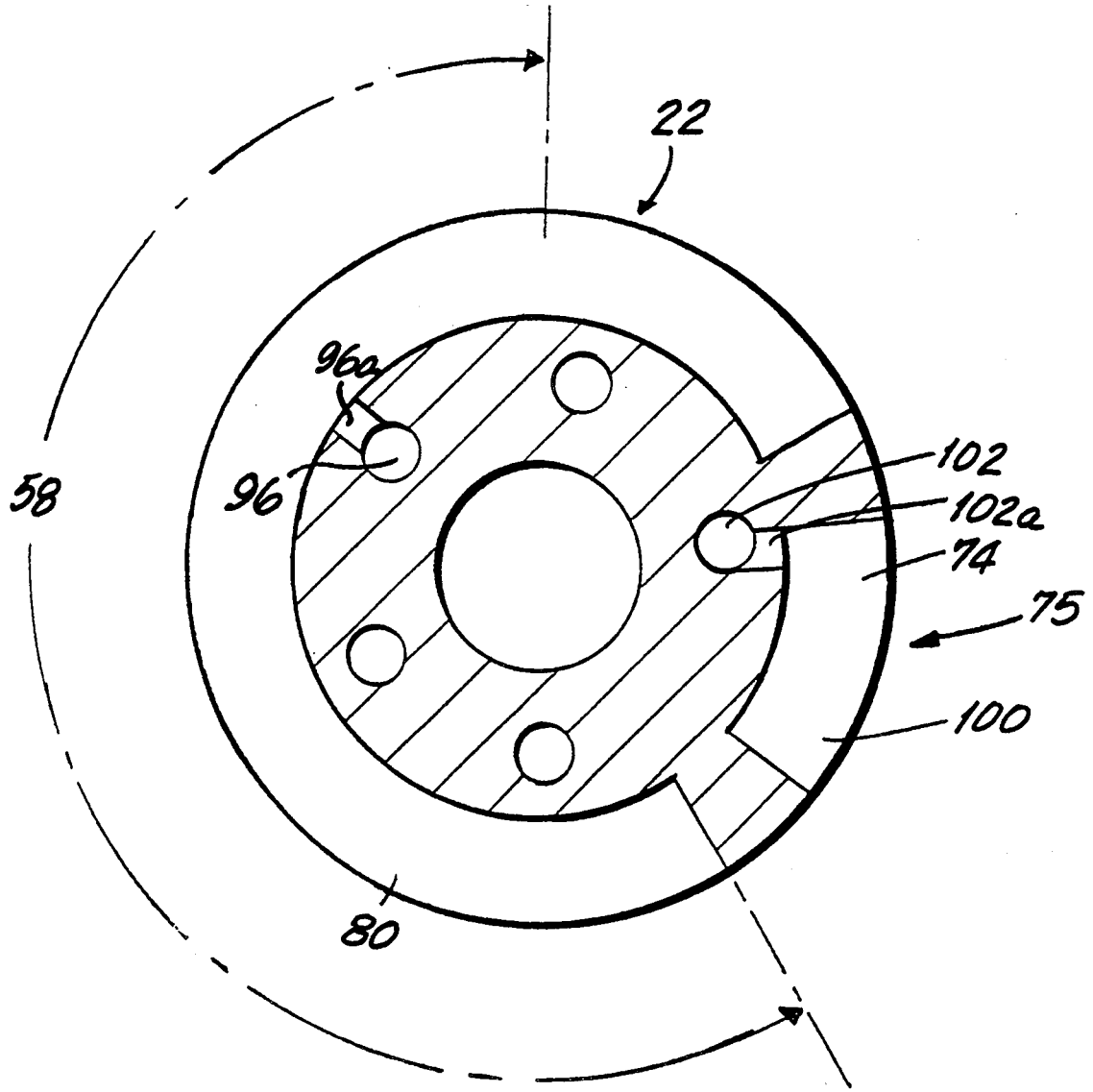
FIG. 10 is a sectional view of the hub showing the second vacuum manifold and blow-off manifold.

Referring now to FIGS. 7 and 10, a second radially extending, slotted vacuum manifold 80 is spaced offset from the first slotted vacuum and pressure manifolds 56, 60. The second manifold 80 begins adjacent where the first vacuum manifold 56 begins. The second manifold 80, however, extends past the article wrapping position 22 approximately 40° (FIGS. 7 and 10). A second trailing edge valve port 82 is positioned on the inner surface of the drum and extends into the drum to a trailing edge plenum 84.

Similar to the leading edge plenum 64, the trailing edge plenum 84 is open and has a trailing edge orifice plate 86 (FIG. 4, not shown in detail) covering the plenum. The trailing edge valve port 82, plenum 84, and orifice plate 86 are configured and dimensioned substantially similar to that of the leading edge valve port 62, plenum 64 and orifice plate 66. The valve port 82, plenum 84 and orifice plate 66 are aligned with that area of the drum surface corresponding to where the trailing edge of a label is positioned. In this embodiment, the trailing edge orifice plate is slightly larger than the leading edge orifice plate (e.g. 13/16 inch as compared to one-half inch for the leading edge) to allow a cutting area to be positioned thereon which engages a cutting blade during "on-drum" cutting. The cutting area can be a hardened, flat insert or a formed "anvil" which protrudes slightly from the surface of the trailing edge orifice plate (shown schematically at 130, FIG. 4). A flattened area typically is more preferred than a formed anvil because the articles will not have an impediment to roll over during wrapping such as a formed anvil could create. As noted, the copending parent application, it is more preferred to use a substantially flat surface area.

A midportion engaging valve port 90 (FIGS. 4 and 9) is positioned between leading and trailing edge valve ports 82, and extends into the drum to a midportion plenum 92 which is open to the surface. An orifice plate 94 (FIG. 4, not shown in detail) covers the open plenum 92. The midportion engaging valve port 90, plenum 92 and orifice plate 94 are dimensioned similar to that of the leading edge valve port, plenum and orifice plate, and are circumferentially aligned with the second slotted vacuum manifold 80 (FIG. 6). All orifice plates 66, 86, and 94 preferably have a resilient surface such as provided by a thin dimensioned rubber insert which provides greater friction for the article as the article is wrapped. The greater friction between the plates 66, 86, and 94 allows less pressure to be applied by the pressure applicator 12.

The second slotted vacuum manifold 80 also communicates via a gate manifold **96*a* with a horizontal vacuum manifold 96. The midportion and trailing edge valve ports 82, 90 move into a position aligned with the second vacuum manifold 80 and vacuum is drawn through the ports 82, 90 and plenums 84, 92 to retain the label onto the surface of the drum throughout the label retention area 58. If the leading edge of a label engages an article, the vacuum draw is broken and as the article rolls, the label is gradually lifted from the surface by means of the rotating action of the article A, similar to the rolling action when opening the top of a "sardine can." Even though vacuum is retained within the second vacuum manifold 96 against the midportions and trailing edge portions of the label, the article continues rolling, and the label wraps about the article because the vacuum is broken within the first vacuum manifold 56** against the label.

As the article continues its rolling while also wrapping the label about the article, the label is gradually lifted off the midportion orifice plate and then lifted off the trailing edge orifice plate, breaking the vacuum seal and allowing complete label wrapping. If the article is not wrapped, such as could occur if the article misfeeds, then, even with the upward pulse of air against the leading edge, the label is retained onto the drum surface by the vacuum draw. The label continues to move with the drum as the drum rotates to a blow-off area.

A slotted, blow-off manifold 74 (FIG. 4) is formed in the hub 44 at a label blow-off area indicated generally by the arc 75 (FIG. 4) starting about 80° past the article wrapping position 22. This manifold 74 is aligned circumferentially with the first vacuum manifold and extends about 45° along the circumferential hub surface. This slotted blow-off manifold 74 is connected to a horizontal pressure manifold 78 via a gate manifold **78*a***.

A second slotted blow-off manifold 100 (FIG. 10) is aligned circumferentially with the second vacuum manifold 80 at a position coextensive with the first blow-off manifold 74. The second blow-off manifold 100 also includes a gate manifold **102*a* positioned between the blow-off manifold 100 and horizontal pressure manifold 102. A source of pressure, which could be the same source used for pressurizing the manifold 60, is connected to the horizontal pressure manifold 102. If a label does not engage an article at the article wrapping position 22, the vacuum drawn within the second slotted vacuum manifold 80 retains the label on the drum surface. As the drum rotates further, the label moves with the drum into the blow-off area 75** where the label is blown away from the drum surface by the pressure exerted through the blow-off manifolds.

As shown in FIG. 4, the drum has six substantially evenly spaced, leading edge valve ports 62 positioned on the inside surface of the drum 54, together with six respective plenums 64 and orifice plates 66. Additionally, (although not illustrated in detail) there are six respective trailing and midportion engaging valve ports 82, 90, plenums 84, 92 and orifice plates 86, 94. This drum construction provides for a nine inch label pitch on the drum (corresponding to a fifty four inch circumference) and, consequently, continuous use of the entire drum surface for labelling purposes without having to rotate the drum each time one article is to be wrapped. Thus, with the present illustrated embodiment, six articles can be wrapped for each one revolution of the drum about the hub.

Figure 9:
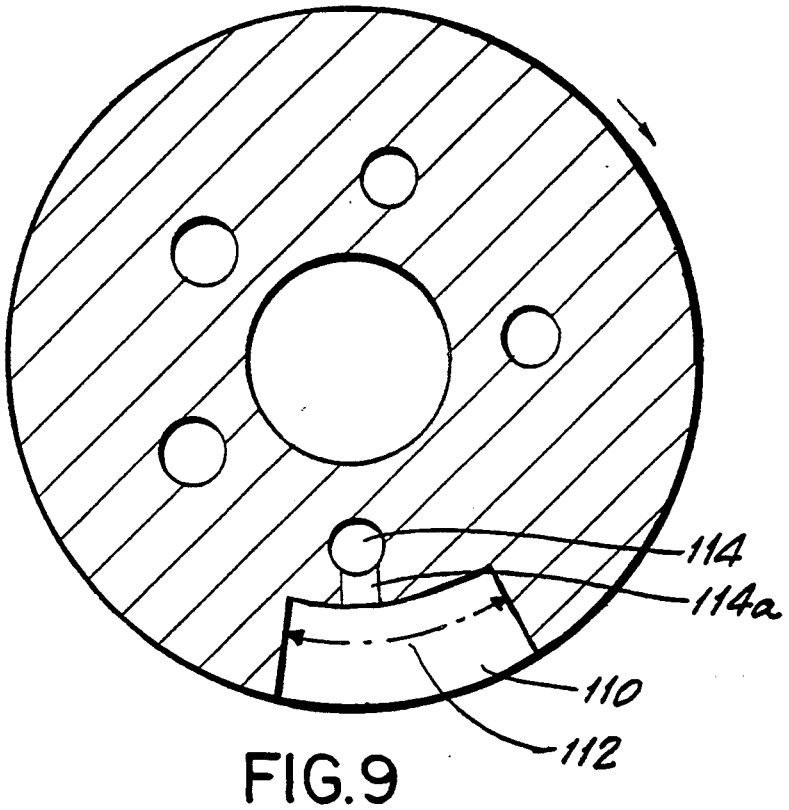
FIG. 9 is a sectional view of the hub showing the label drag manifold.

As illustrated in FIGS. 7 and 9, a third radially extending, slotted label drag manifold 110 is spaced offset (side-by-side) between first and second vacuum manifolds 56, 80. This drag manifold 110 extends circumferentially from a position where the label drag area 22 begins through a peripheral arc distance of about 40°–50°. The drag manifold 110 defines a label drag area, indicated generally by the arc 112, where the label is first supplied to the drum surface as a strip of label material. A horizontal manifold 114 extends through the hub and communicates with the drag manifold 110 via a gate manifold **114*a***.

A plurality of sequentially aligned, and evenly spaced drag valve ports 118 are positioned on the inside surface of the drum and extend into open, drag plenums 120 which have covering orifice plates 122 and orifices 124 (FIG. 5). As illustrated the drag valve ports 118 are evenly spaced between those areas of the drum surface where the individual labels are positioned. The strip of label material is initially fed to the drum surface where the drum rotation speed is faster than the speed the strip is advanced onto the drum, causing some slippage between the drum and strip. The unwind motors and feed rollers allow sufficient film withdrawal for one label length. As described before, the film is cut into labels by the knife positioned on the cutting roll timed in synchronism with the label transport drum. When the label transport drum has rotated so that the film corresponding to the trailing edge is aligned with the cutting area or upraised anvil 130 the film is cut. Such synchronism is provided by means of a controller (not shown) which receives signals from the drum encoder, film registration sensor 36 and encoder coupled to the cutting assembly. Adjustments to film feed are made as necessary to ensure proper film positioning during cutting. As another cut label is required, the film is fed, moved to the cutting position, and then cut by the knife assembly 55.

As the vacuum secured label moves with the rotating drum 54, the leading edge of the label advances to an adhesive applying position adjacent to an adhesive applicator, indicated generally at 160. One type of applicator, which can be used is described more fully in the copending parent application Ser. No. 07/906,573. The adhesive applicator 160 applies by printing an adhesive to the area adjacent the leading edge 21*a* of the label. The adhesive applicator may include an adhesive application roller 162, with outwardly extending adhesive wipers 164. The adhesive wipers 164 can be formed from a strip of resilient rubber, silicone or other material. The wiper engages a rotating gravure roller 166 which transfers the adhesive to the wipers. The depth of indentations in the gravure roller 166 determine the amount of transferred adhesive. The gravure roller 166 engages an adhesive supply as is customary in the art. The wipers 164 engage the leading edge of the label at the substantially same surface speed and "print" the adhesive onto the leading edge.

As noted in the foregoing copending '573 patent application, a cold adhesive is more desirable than a hot melt adhesive because a hot melt adhesive tends to distort the thin label material, forming an adhesive joint of poor appearance and low seam quality. As used herein, the term cold adhesive is defined as those adhesives that are viscous at room temperature, as compared to conventional hot melt adhesives that are inherently solid at room temperature and become viscous only at elevated temperatures. Potential cold adhesives could be water or solvent based adhesives with suspended solids, and potentially rubber-based solvent and latex adhesives. Other adhesive applicator mechanisms not described in the aforementioned copending patent application also could be used as long as adequate adhesive is neatly and aesthetically applied according to manufacturing and quality guidelines.

After the cold adhesive is applied to the area adjacent the leading edge of the label, a solvent application system, indicated generally at 170, evenly applies solvent without mottling or solvent streaking in a precise pattern to the area adjacent the trailing edge of the label. The preferred solvent is an organic solvent and reacts to the film material. THF has been found to be an acceptable solvent.

The solvent reacts with the film material, dissolving a portion of the area adjacent the trailing edge to provide a tacky quality to that area, so that the trailing edge can be retained to the leading edge by a solvent-seal bond when the label is circumferentially wrapped around the article. The solvent is preferably applied after the adhesive is applied, to ensure that the solvent does not evaporate before the trailing edge of the label has overlapped the leading edge. As illustrated, the solvent application system 170 is positioned ahead of the adhesive applicator 160 in the direction of drum rotation so that the label first engages the adhesive applicator 160, then the solvent application system 170.

In the illustrated embodiment of FIG. 1, the solvent application system 170 includes two static wiper assembly housings 172*a*, 172*b* (FIG. 1C) each one having a porous wiper body and wiper tips 174 extending outward from the wiper body. THF or other solvent is metered into the housing onto the wiper tip 174 from a solvent reservoir 176. The wiper body is formed from a porous material such as felt which allows solvent to be applied by a drip feed system thereon. The solvent then can flow by means such as capillary action to the wiper tip. A preferred vacuum scavenge system meters the amount of solvent. One type of scavenge system which would be used is described in U.S. Pat. No. 4,844,760 to Dickey, the disclosure which is incorporated herein by reference. The return line "R" provides for scavenge capability, and is exposed to subatmospheric pressure, forming a vacuum draw.

The first wiper assembly 172*a* cleans the trailing edge of the label—removing dirt and softening the trailing edge by applying a minor amount of solvent. The second wiper assembly 172*b* applies the solvent that "bites" or "etches" into the film to provide the welding action needed to secure the trailing edge in overlapping, secured solvent-seal relationship to the leading edge of the label when the label is wrapped about an article. It is estimated that about twice as much solvent could be applied by the second wiper assembly 172*b* than the first 172*a* to provide for sufficient solvent-seal bonding.

The solvent application system in another embodiment illustrated schematically in FIG. 1B as 170', includes a wiper member, indicated generally at 180, formed as a drum 182 that is mounted for rotation adjacent the label transport drum. The drum 182 includes two outwardly extending, tapering, and narrowing flexible tips 184. The tips 184 are preferably formed from a resilient material, which is not highly reactive to the solvent. The flexible tip 184 typically provides some resiliency to allow deflection of the tip against the label and drum surface, while retaining at least some stiffness to exert a wiping force against the label. Materials which may be used include felt, a cloth covering a felt wiper member, a soft cord, some silicones and urethanes, as well as other materials that are not highly reactive to the solvent, but have appropriate resilience for a wiper.

In accordance with that illustrated embodiment, the wiper tip 184 is moved at a surface speed different from the surface speed of the rotating label transport drum. As the tip engages the area adjacent the trailing edge of the label, a bead of solvent is applied onto a finite area instead of being poorly applied as if by splashing. The solvent, such as THF, is about half as viscous as water and the speed differential between the wiper tip and label transport drum has been found to be beneficial in controlling solvent application and in applying solvent adjacent to, but spaced from the leading edge.

After solvent application, as the article rolls back over the solvent penetrated area of the label, the article weight pushes the solvent back across that area to the trailing edge of the label. This rolling motion across the solvent penetrated area has the effect of producing two wipes with each one wiper tip application, causing a more even spreading of solvent. The speed differential can be obtained by using a servomotor or elliptical gear arrangement. In one embodiment the surface speed of the wiper tip 184 is faster than the surface speed of the label transport drum. In another embodiment, the surface speed is slower. If the wiper speed is slower than the surface speed of the label transport drum, the solvent is wiped toward the trailing edge of the label. If the wiper tip is moving faster than the label transport drum, the solvent is wiped from the trailing edge of the label forward.

This speed differential between a wiper tip and label moving with the drum is maximized with the use of the static wiper assemblies 172*a*, 172*b* as shown in FIGS. 1 and 1C.

Referring now to FIGS. 11 through 18 the second embodiment of the label transport drum is illustrated. Similar reference numerals as describing the first embodiment are used except, in this description of the second embodiment, reference numerals in the 200 and 300 series are used for different elements of the drum and hub, and new drum elements are described with reference numerals beginning in the 400 series. The hub and drum diameter and circumference dimensions in the second embodiment are substantially similar to those dimensions in the first embodiment.

Figure 17:
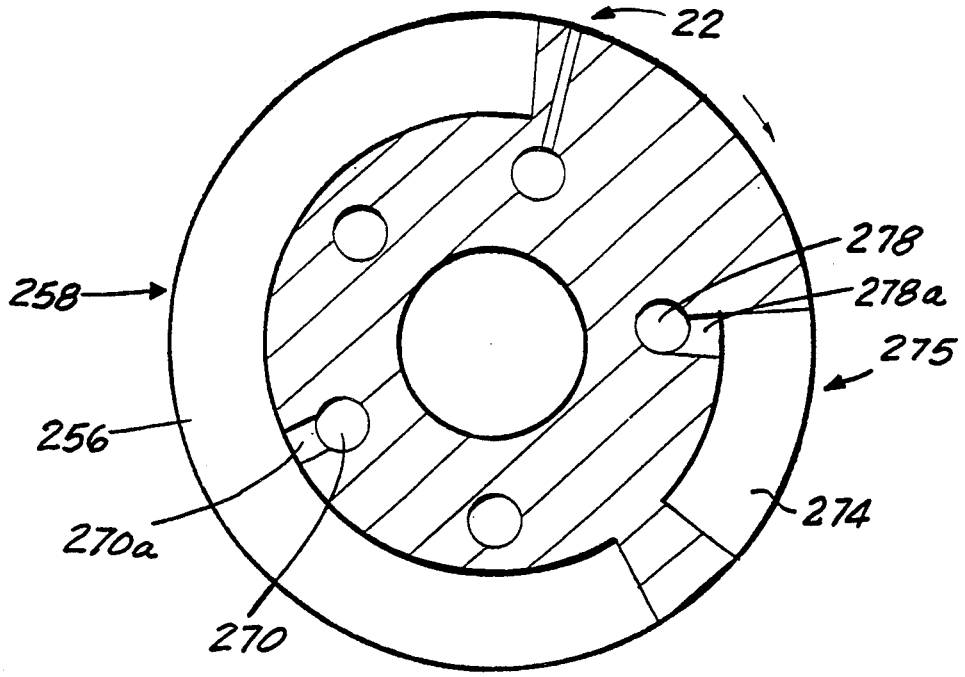
FIG. 17 is a sectional view of a second embodiment of the hub showing the first vacuum and pressure manifolds and the blow-off manifold.

As shown in FIGS. 17 and 18, this embodiment includes first and second radially extending, slotted vacuum manifolds 256, 280 and blow-off manifolds 274, 300. A drag manifold as disclosed in the first embodiment is not included in this second preferred embodiment because the label is cut "off-the-drum" as compared to the "on-drum" cutting in the previous embodiment where a drag manifold 110 is required to drag the label while allowing slippage relative to the drum surface. Because there is no drag manifold, the drum surface does not include the drag orifice plates as disclosed before. This embodiment using off-drum cutting has been found to be preferred over cutting "on-the-drum."

Figure 14:
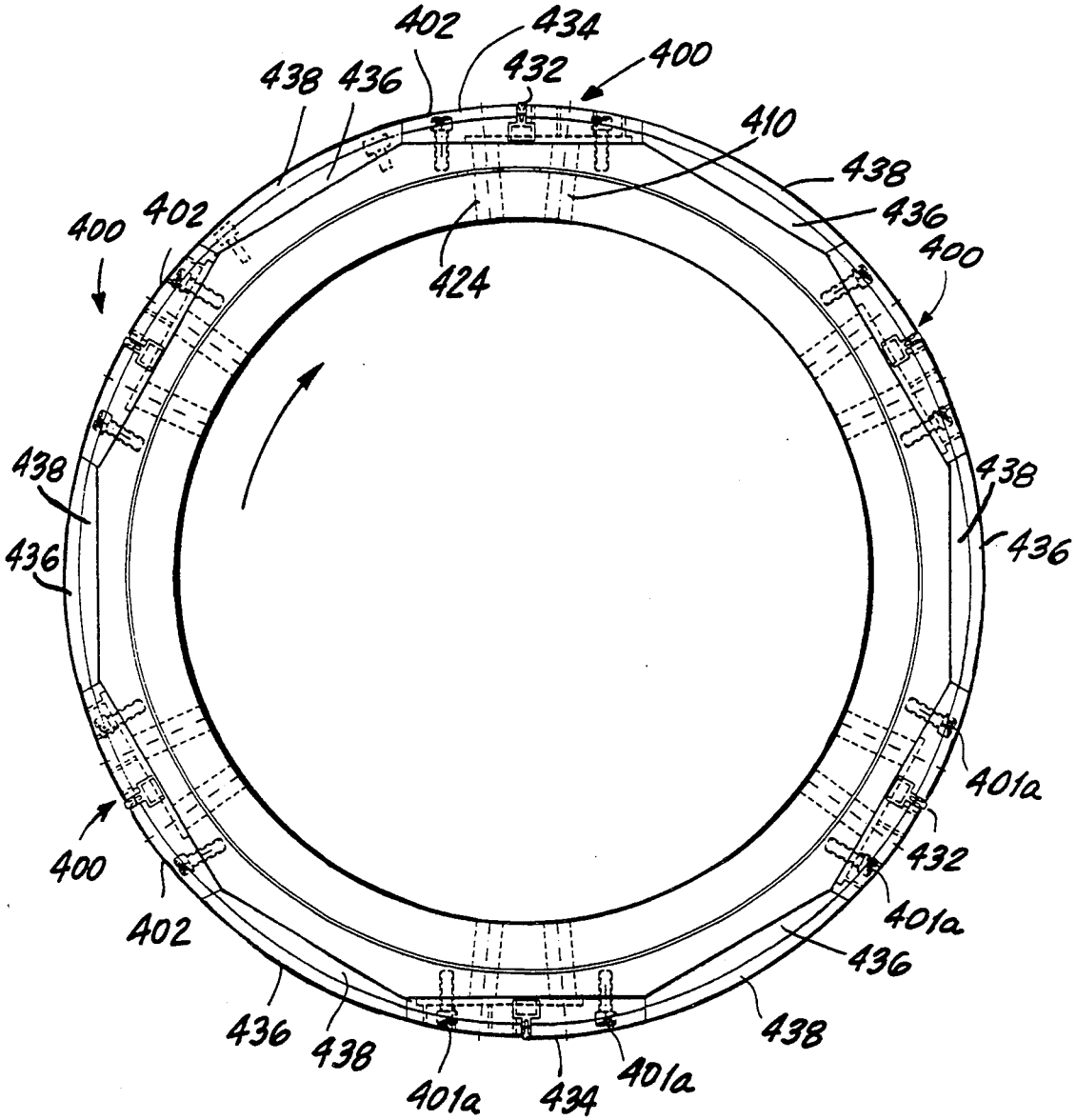
FIG. 14 is a partial sectional view of the drum showing the six evenly spaced label retaining insert plates and rubber coated surface plates spaced between the insert plates.
Figure 16:
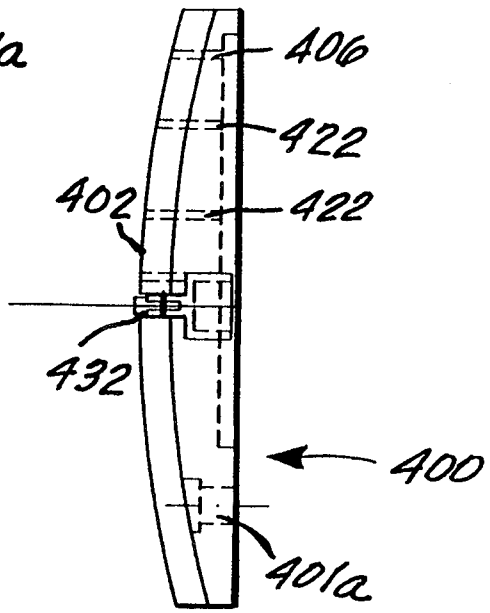
FIG. 16 is a side elevation view of a label retaining insert plate.
Figure 15:
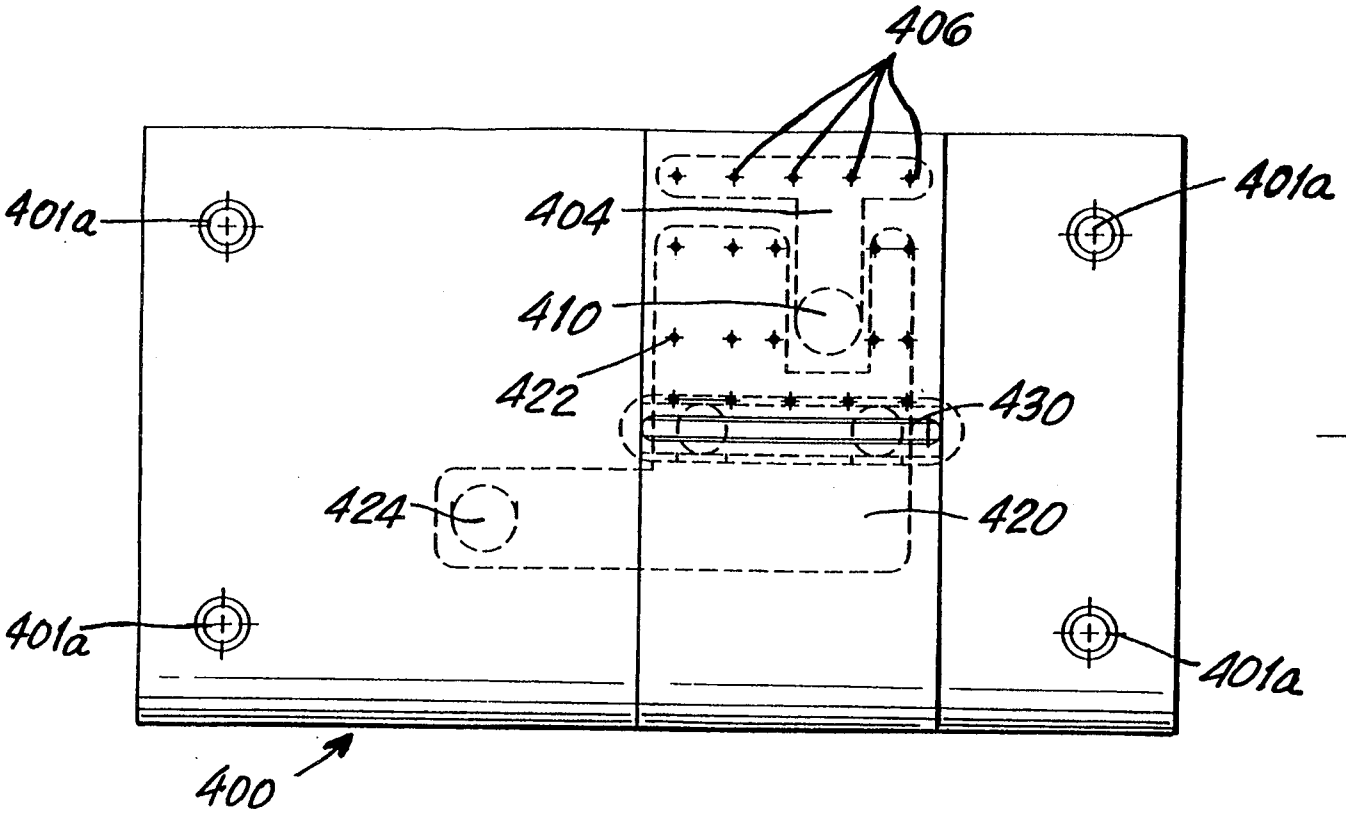
FIG. 15 is a plan view of a label retaining insert plate.

As shown in FIG. 14, the label transport drum 10 of the present embodiment includes six evenly spaced label retaining insert plates 400. Each insert plate 400 is rectangular configured and has a top surface 402 that is configured substantially similar to the curvature of the drum surface. The undersurface of each insert plate 400 includes two plenums formed in the surface. A first plenum 404 is formed on the undersurface and has orifice holes 406 (FIG. 15) extending upward to communicate with the surface of the insert plate at that area where the leading edge of the label is positioned. The first plenum 404 includes a port 410 which is positioned in circumferential alignment with the first vacuum manifold 56 and pressure manifold 60.

A second plenum 420 is formed in the undersurface and has orifices 422 extending therethrough to communicate with the surface of the insert plate 400 at an area where the trailing edge and midportion of the label are positioned. This second plenum extends to a port which is aligned circumferentially with the second vacuum manifold 280.

A slot 430 is formed in the upper surface of the insert plate 400 and extends transversely across the plate (FIGS. 11, 12 and 14–16). A spring biased plunger 432 is positioned in the slot 430 and biased upward against the trailing edge of the label positioned on the insert plate 400. As the label moves past the static wiper members, the outwardly biased trailing edge of the label engages the static wiper members 172*a*, 172*b* receiving solvent on the trailing edge. As the article is initially wrapped, the article rolls against the plunger 432, forcing it downward, thus providing the desired substantially smooth surface. As a result, the plunger 432 does not interfere with the article's smooth movement along the drum surface.

Each insert plate also has a rubber insert 434 placed over a substantial portion of the outer surface of the insert plate. The orifices and slot are formed also within the rubber insert 434. Additionally, rubber coated, surface plates 436 are positioned between the label retaining insert plates 400. The plates 436 also include an insert 438, formed from a resilient material such as rubber to provide a resilient surface on which the articles engage. The rubber inserts 434, 438 form a soft cushion on which the article rolls during wrapping. Because the rubber acts as a cushion, the article is deflected slightly into the cushion material by means of the pressure applicator 12 so as to create a "footprint" in the soft cushion insert material. During article wrapping, the air is squeezed out between the article, label, and drum surface, allowing better wrapping of the label about the article. Additionally, the inserts 434, 438 have greater friction between the articles and the drum surface as compared to a steel or aluminum surface so that the less pressure can be applied by the pressure applicator 17.

The second embodiment using the insert plates is limited to the use of about a four and one half inch long label, corresponding to about four and a half inch wide insert plates 400. However, that length is adequate for labeling various sizes of conventional small dry cell batteries and other similar articles such as lipstick tubes and lip balm containers.

If longer labels are to be used for larger diameter articles, the insert plates 400 can be made deeper, and thus longer along the arcuate portion of the top surface since the plate is longer and has a longer surface length along which the arc extends. However, the length is still limited because too deep an insert plate would interfere with the drum rotation about the hub. A larger drum and hub would have to be constructed. The first embodiment using drag ports can be designed so that instead of three orifice plates on which the label is positioned and the vacuum drawn, four or perhaps five orifice plates could be used, to enable positioning of a longer label on the drum.

METHOD OF OPERATION

The operation in accordance with the present invention will be described using the preferred second embodiment of the label transport drum and apparatus shown in FIGS. 11–18.

In operation a strip 28 of film label material is fed from the label supply roll 26*a*, through the dancer roll assembly 32 and into the off-drum cutting mechanism 14. As the drum rotates, the cut label is transferred to the drum surface onto the label retaining insert plate 400. The vacuum drawn within the first and second manifolds is drawn through the first and second plenums 404, 420 and orifices 406, 422 to retain the label on the drum surface. A control mechanism including servomechanisms, a dancer arm potentiometer and other controls provides for constant film withdrawal speed during operation and proper transfer of the label onto the insert plates where the trailing edge of the label is aligned over the plunger 432.

An adhesive is applied by the adhesive applicator 160 onto the area adjacent the leading edge 21*a* of the label.

As the drum continues its rotation, the trailing edge moves adjacent the wiper members. The spring biased plunger 432 has pushed the trailing edge of the label outward from the drum surface. As a result, the outwardly biased trailing edge of the label engages the wiper members 172*a*, 172*b*, so as to apply a predetermined amount of solvent onto the trailing edge of the label.

As shown in greater detail in FIG. 1, the articles A are initially conveyed on a flat belt conveyor 190 and into a star transfer wheel 192. The star wheel 192 rotates, transferring the articles A one at a time into an inclined belt conveyor 194 to provide a sufficient head of articles for process flow control. The articles can be fed in a double row, in side-by-side manner, each pair of articles having complementary pairs of labels to be applied thereto. For purposes of illustration, the figures show only one row of fed articles—the other row of slots on the article transfer wheels being empty. The apparatus can be readily designed for working with either one or two rows of fed articles.

Figure 2:
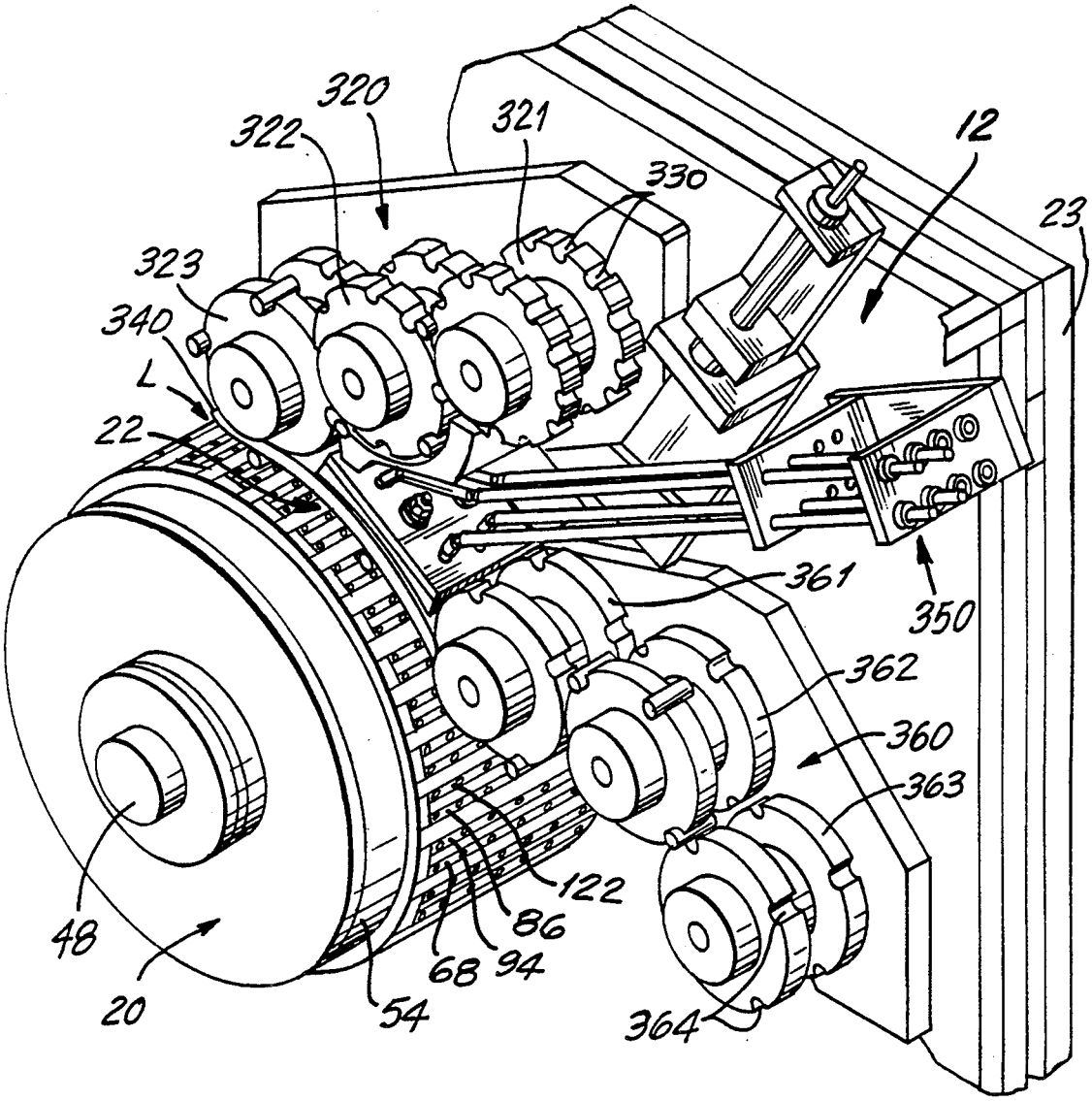
FIG. 2 is a pictorial view of one embodiment of the label transport drum and associated components where film is fed initially onto the label transport drum and subsequently cut.
Figure 3:
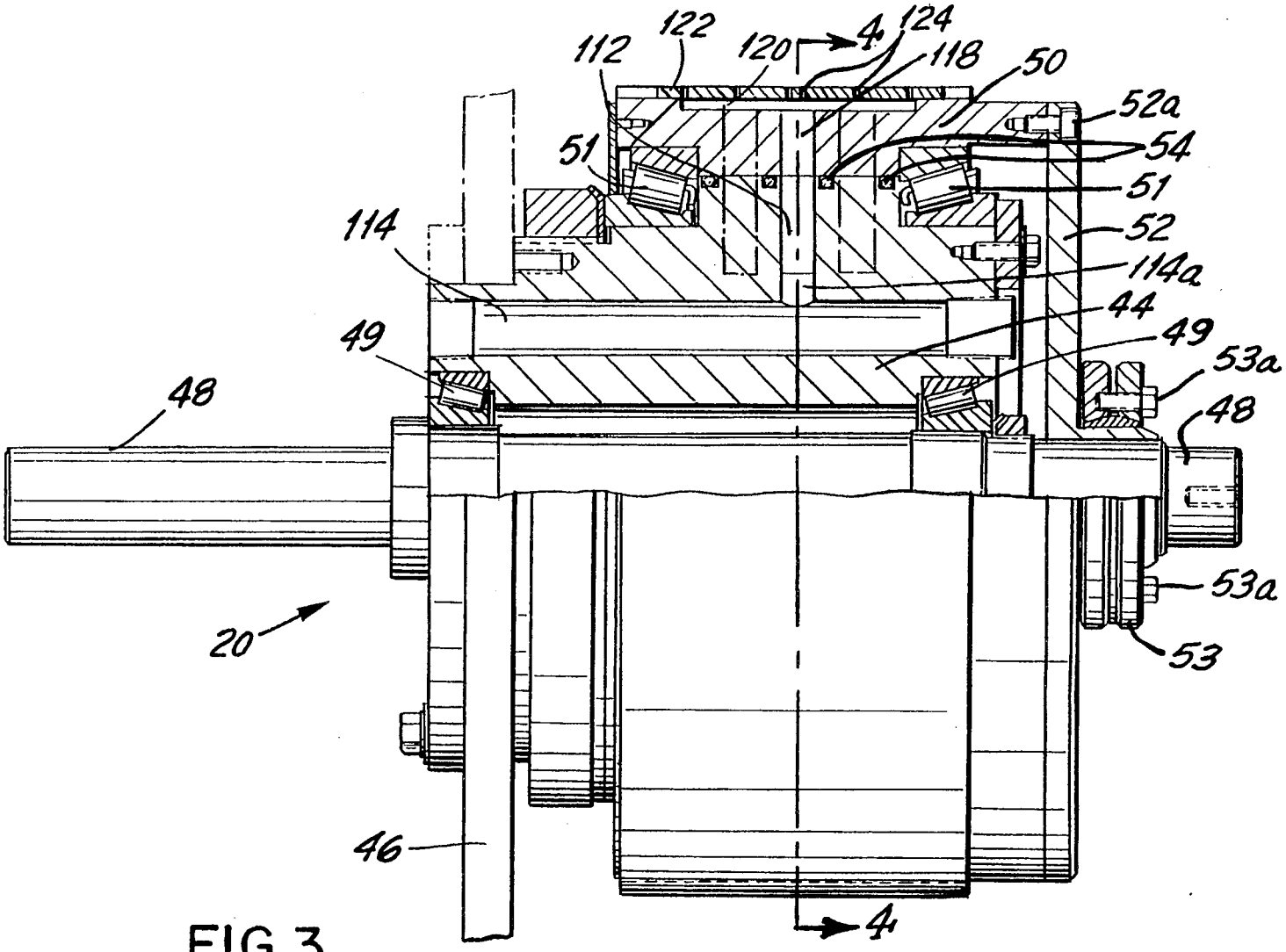
FIG. 3 is a partial sectional view of one embodiment of the label transport drum showing the slotted drag manifold.

The belt conveyor transports the articles A into an inclined gravity chute 196 having a serpentine channel 198 for slowing the movement of the articles A downward from the height of the inclined belt conveyor. Articles A then are fed into a serpentine timing wheel assembly, indicated generally at 320, where a tangential, rotative movement is imparted to the articles A. The articles A traverse around the serpentine timing wheel assembly 320, which includes three transfer wheels 321, 322, 323 mounted on spindles 321*a*, 322*a*, 323*a* connected to the frame (FIG. 2).

Figure 11:
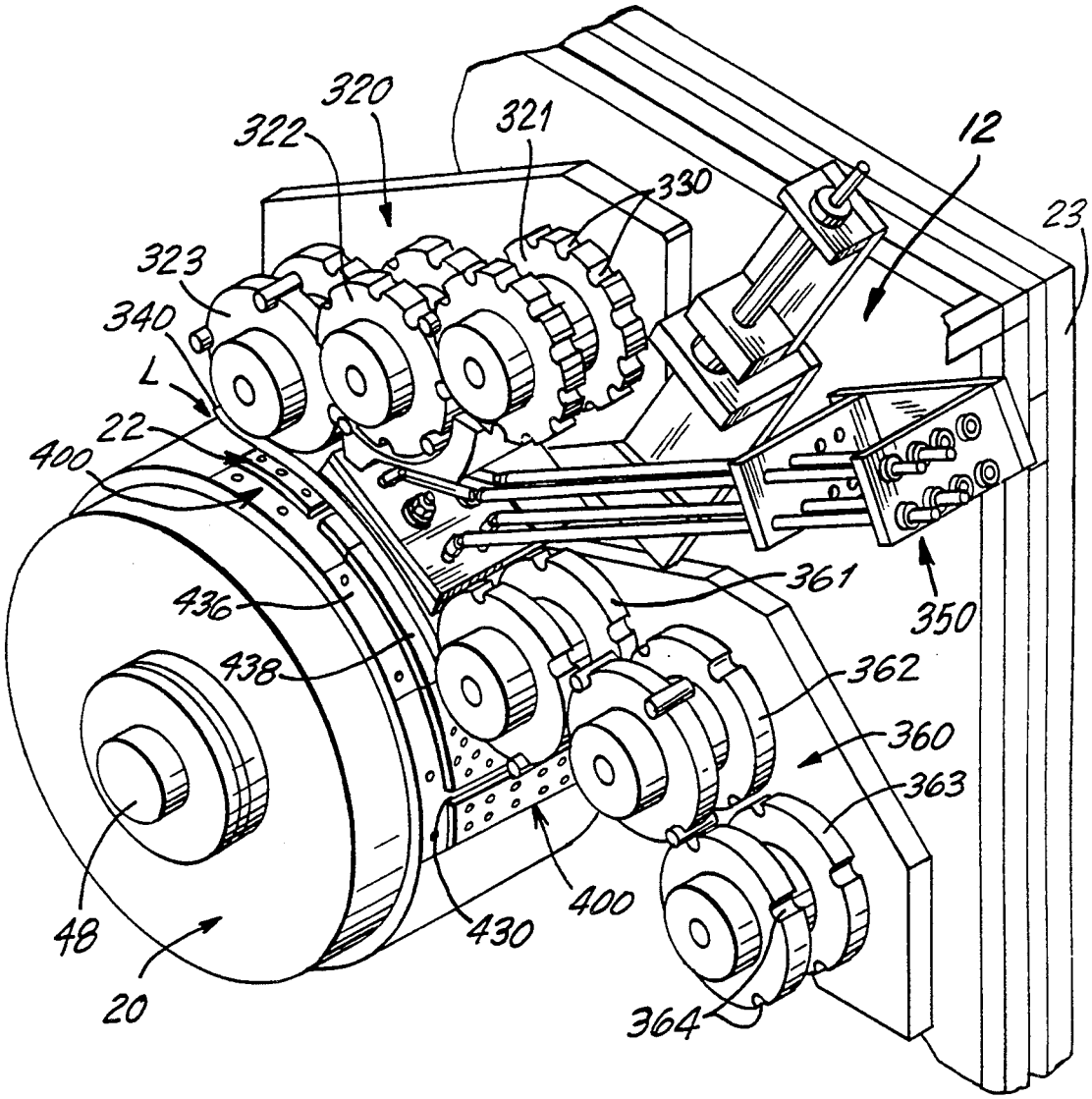
FIG. 11 is a schematic pictorial view of an embodiment of the label transport drum used for "off-drum" cutting where the respective labels rest on respective label retaining insert plates.

Each transfer wheel has article carrying positions 330 for holding and conveying the articles. As illustrated best in FIG. 11, the first transfer wheel 221 has twelve article carrying positions. The second transfer wheel has eight, and the third has four. FIG. 11 illustrates an embodiment where the transfer wheels comprise dual disk assemblies with a central hub, each disk having an article receiving slot on its periphery. Two or more discs can be used (FIG. 12) as long as the articles can be conveyed thereon. Alternately, a one-disc, wide transfer wheel can be used. FIG. 12, illustrates covering shields 332 for protecting the transfer wheels and preventing articles from being spun outward therefrom.

The transfer wheels accelerate movement of the articles into contact with the surface of the drum. As the article leaves the third transfer wheel 323, the article engages the entrance portion of a downwardly inclined pressure plate 340 of the pressure applicator which imparts a spin to the article to move the article into tangential spinning engagement with the surface of the label transport drum 20. The articles A traverse along the drum surface, held to its surface by the pressure plate 340 (FIG. 12) of the pressure applicator assembly 12, which also acts as a retaining shield. The label transport drum 12 rotates faster than the spinning articles, imparting and maintaining spin to the articles A.

Because the drum is rotating faster than the spinning articles A, a label moves from the label drag area 258 into engagement with an article A at the article wrapping position 22.

As the drum continues its rotation, the leading edge 21*a* of the label moves into the article wrapping position 22. If an article is fed properly into that position, the leading edge is blown upward away from the drum surface by means of the pressurized air blowing from the first pressure manifold 260.

The adhesive on the leading edge forms a "tack" bond on the article. At the point defined by the leading edge of the label, as the article rolls the label upward against the body of the article, the vacuum seal between the label and the surface of the drum is broken. Thus, the vacuum drawn in the second vacuum manifold 280 and through the orifices engaging the midportion and trailing edge of the label. This action is similar to the opening of a "sardine can."

If the labels are mismatched, i.e., the ends are unaligned, a control rod assembly indicated generally at 350 (FIGS. 11 and 12), of the pressure applicator 12 is adjusted to change the camber of the pressure plate 340 engaging the articles to impart the desired pressure against selected sides and ends of the article so that the label is aligned correctly on each article as they are wrapped. As the article continues its rotation around the drum surface, the article then is removed by a serpentine timing wheel assembly, indicated generally at 360, and having three transfer wheels 361, 362, 363. Each transfer wheel has four article engaging slots 364. The articles then move onto a flighted bed belt conveyor 366. Alternatively, the articles can be removed via a chain conveyor system (not illustrated) instead of the illustrated transfer wheels.

The conveyor transports the articles into an oven 367 where the articles are heated and the label film heat shrunk around the articles A. A manual swing arm assembly 370 supports a modular control unit 372 (FIG. 1) providing access for a user to the machine controls.

If the leading edge of the label does not properly engage the article A, the article is not wrapped, and thus the vacuum between the label and drum surface is not broken, and the vacuum draw in the second slotted vacuum port 280 retains the label onto the drum surface past the article wrapping position 222. As the drum rotates, the label moves into the article blow-off area 275 where the label is blown outward from the drum surface so as not to interfere with subsequent labels and articles fed into the article wrapping position.

In the first embodiment shown in FIGS. 2–10, the operation is similar to that as described, except the label is fed as a strip to the drum. Vacuum is drawn through the drag manifold and orifices in the drag orifice plate to initially hold and drag the film strip. The label is cut. As new labels are required, more label is fed and cut. This "on-drum" cutting requires intermittent feeding and film slippage on the drum surface. The unwind motor will increase and decrease speed during production possibly causing some motor spikes.

It should be understood that the foregoing description of the invention is intended merely to be illustrative thereof, and that other embodiments, modifications and equivalents may be apparent to those skilled in the art without departing from its spirit.

That which is claimed is:

1. An apparatus for applying thin film polymer labels to small cylindrical articles comprising:

a label transport drum having an inner cylindrically configured hub and a cylindrical drum rotatably mounted on said hub, means for rotating said drum on said hub, means for supplying a label to the surface of said drum, means for applying an adhesive onto an area adjacent the leading edge of a label while said label is moving with said drum, means for applying a solvent onto an area adjacent the trailing edge of the label while said label is moving with said drum, means for conveying cylindrical articles into tangential spinning engagement with said drum and into rotative engagement with the leading edge of a label at an article wrapping position so as to transfer the label onto the article, a radially extending, slotted vacuum manifold defining a label retention area and extending circumferentially around a substantial portion of the circumference of said hub, and a radially extending slotted pressure manifold aligned circumferentially after said slotted vacuum manifold at said article wrapping position, means for drawing a vacuum within said slotted vacuum manifold, means for pressurizing said slotted pressure manifold, and valve port means positioned on the inner surface of said drum and communicating with the surface of said drum in an area where a label is positioned for receiving the vacuum draw from said vacuum manifold to retain said label onto the surface of said drum as said label moves through said label retention area, and for receiving pressure from said pressure manifold to blow the leading edge of the label into engagement with an article positioned at the article wrapping position to aid in article wrapping.

2. An apparatus according to claim 1 wherein said valve port means communicates with the surface of said drum in an area where the leading edge of a label is positioned.

3. An apparatus according to claim 1 including a label blow-off area positioned past said article wrapping position, and means for blowing air outward onto a label retained on the drum surface at said label blow-off area.

4. An apparatus according to claim 3 including means for retaining said label on the surface of said drum past said article wrapping position and into said label blow-off position when an article misfeeds.

5. An apparatus according to claim 3 wherein said means for blowing air at said blow-off area comprises a radially extending, slotted blow-off manifold circumferentially aligned and positioned after said pressure manifold, and means for pressurizing said blow-off manifold with air wherein said valve port means receives said air from said blow-off manifold to blow-off a label from said drum surface.

6. An apparatus according to claim 1 wherein said valve port means comprises a valve port on the inner surface of said drum and aligned circumferentially with said vacuum and pressure manifolds, said valve port forming a bore opening extending radially outward through said drum, and including a plate covering said bore, said plate having orifice means communicating with said bore opening for drawing vacuum onto a label as vacuum is drawn through said vacuum manifold and bore.

7. An apparatus according to claim 6 including a plenum positioned on the undersurface of said plate and communicating with said bore opening, and a plurality of orifices extending from the surface of said plate to the plenum.

8. An apparatus for applying thin film polymer labels to small cylindrical articles comprising:

a label transport drum having an inner cylindrically configured hub and a cylindrical drum rotatably mounted on said hub, means for rotating said drum on said hub, means for supplying a label to the surface of said drum, means for applying an adhesive onto an area adjacent the leading edge of a label while said label is moving with said drum, means for applying a solvent onto an area adjacent the trailing edge of a label while said label is moving with said drum, means for conveying cylindrical articles into tangential spinning engagement with said drum and into rotative engagement with the leading edge of a label at said article wrapping position so as to transfer the label onto the article, a first radially extending, slotted vacuum manifold defining a label retention area and extending circumferentially around a substantial portion of the circumference of said hub, and a first radially extending slotted pressure manifold aligned circumferentially after said first vacuum manifold and at said article wrapping position, a second radially extending, slotted vacuum manifold spaced offset from said first vacuum and pressure manifolds and extending circumferentially past said label drag area and terminating at a position past said article wrapping position, means for drawing a vacuum within said first and second slotted vacuum manifolds, means for pressurizing said first slotted pressure manifold, first valve port means positioned on the inner surface of said drum and communicating with the surface of said drum in an area where the leading edge of a label is positioned for receiving the vacuum draw from said first vacuum manifold to retain the leading edge of said label onto the surface of said drum, and for receiving pressure from said first pressure manifold at the article wrapping position to blow the leading label edge from said drum surface onto an article positioned thereat, and second valve port means positioned on the inner surface of said drum and communicating with the surface of said drum in an area where the trailing edge and midportions of the label are positioned for receiving the vacuum draw from the second slotted manifold to retain the label onto the surface of the drum 1) in the label drag area and 2) past the article wrapping position if a label does not engage an article at the article wrapping position.

9. An apparatus according to claim 8 including an article blow-off area positioned past the end of the second vacuum manifold and means for blowing air outward onto a label retained on the drum surface.

10. An apparatus according to claim 9 wherein said means for blowing air outward at said label blow-off area comprises first and second radially extending, slotted blow-off manifolds aligned circumferentially with and positioned after respective first and second vacuum manifolds and said pressure manifold, and means for pressurizing said blow-off manifolds wherein said first and second valve port means receive the pressurized air to blow-off the label.

11. An apparatus according to claim 8 wherein said first valve port means comprises a leading edge valve port positioned on the inner surface of said drum and aligned circumferentially with said first vacuum and pressure manifolds, said valve port forming a bore opening extending through said drum, and a label retaining insert plate covering said bore, said plate having orifice means communicating with said bore opening for drawing vacuum onto the leading edge of a label.

12. An apparatus according to claim 11 wherein said second valve port means comprises a second valve port positioned on the inner surface of said drum and aligned circumferentially with said second slotted vacuum manifold, said valve port forming a second bore opening extending through said drum, said label retaining insert plate covering said bore, said plate having second orifice means for drawing vacuum onto the trailing edge and midportion of a label.

13. An apparatus for applying thin film polymer labels to small cylindrical articles comprising:

a label transport drum having an inner cylindrically configured hub and a cylindrical drum rotatably mounted on said hub, means for rotating said drum on said hub, means for supplying a strip of label material to the surface of said drum, means for cutting the strip of label material into labels of predetermined size while said strip is on said drum, means for applying an adhesive onto an area adjacent the leading edge of a label while said label is moving with said drum, a wiper member having a flexible solvent application tip positioned adjacent said label transport drum for engaging the trailing edge of a label as the label moves adjacent thereto so as to apply a predetermined amount of solvent onto the area adjacent the leading edge of said label, means for conveying cylindrical articles into tangential spinning engagement with said drum and into rotative engagement with the leading edge of a label at an article wrapping position so as to transfer the label onto the article, a radially extending, slotted vacuum manifold defining a label retention area and extending circumferentially around a substantial portion of the circumference of said hub, and a radially extending slotted pressure manifold aligned circumferentially after said vacuum manifold at said article wrapping position, means for drawing a vacuum within said vacuum manifold, means for pressurizing said pressure manifold, and valve port means positioned on the inner surface of said drum and communicating with an area on the drum surface where a label is positioned for receiving the vacuum draw from said vacuum manifold to retain the label onto the surface of said drum as said label moves through said label retention area, and for receiving pressure from said pressure manifold to blow the leading edge of the label into engagement with an article positioned at the article wrapping position.

14. An apparatus according to claim 13 wherein said wiper member includes first and second static wiper members.

15. An apparatus according to claim 13 wherein said wiper member comprises a rotatable wiper member having at least one outwardly extending, flexible wiper tip, and means for rotating said wiper member so that the wiper tip engages the trailing edge of a label moving with said drum.

16. An apparatus according to claim 15 wherein said wiper member rotates so that the surface speed of the wiper tip is different from the surface speed of the label transport drum.

17. An apparatus according to claim 13 including a second radially extending, slotted vacuum manifold spaced offset from said first vacuum and pressure manifolds and extending circumferentially past said article wrapping position, and second valve port means positioned on the inner surface of said drum and communicating with the surface of said drum in an area where the trailing edge and midportions of the label are positioned for receiving the vacuum draw from the second vacuum manifold and retaining the label onto the surface of the drum 1) through the label retention area and 2) past the article wrapping position when a label does not engage an article at the article wrapping position.

18. An apparatus according to claim 13 including a third radially extending slotted vacuum drag manifold spaced offset from said first and second slotted vacuum manifolds and extending circumferentially from a position where said first and second vacuum manifolds begin through a peripheral distance on said hub less than the distance of said first vacuum manifold to define a label drag area where the label material is initially supplied to the drum surface, and valve port means positioned on the inner surface of said drum and aligned circumferentially with said drag manifold, said valve port means communicating with the surface of said drum in an area in front of where a label is positioned for securing a strip of label material initially supplied to the surface of the drum as the drum rotates so as to move the strip into a cutting position.

19. An apparatus for applying thin film polymer labels to small cylindrical articles comprising:

a label transport drum having an inner cylindrically configured hub and a cylindrical drum rotatably mounted on said hub for rotation thereabout, means for rotating said drum about said hub, means for supplying a strip of label material to the surface of said drum, means for cutting the strip into labels of predetermined size while said strip is retained on the drum surface, means for applying an adhesive onto an area adjacent the leading edge of a label while said label is moving with said drum, means for applying a solvent onto an area adjacent the leading edge of a label while said label is moving with said drum, means for conveying cylindrical articles into tangential spinning engagement with said drum and into rotative engagement with the leading edge of a label at said article wrapping position so as to transfer the label onto the article, a first radially extending, slotted vacuum manifold defining a label retention area and extending circumferentially around a substantial portion of the circumference of said hub, and a first radially extending slotted pressure manifold aligned circumferentially after said slotted vacuum manifold in the direction of rotation of said drum at an article wrapping position, a plurality of leading edge valve ports substantially evenly spaced on the inner surface of said drum and aligned circumferentially with said vacuum and pressure manifolds, means positioned within said drum and communicating with respective valve ports and with the surface of said drum at respective areas where the leading edges of labels are positioned, means for drawing a vacuum within said vacuum manifold and through said leading edge valve ports for retaining the leading edge of labels onto the surface of said drum, and means for pressurizing said pressure manifold to blow-off the leading edge of a label from the drum surface onto an article thereat when a valve port is aligned over the pressure manifold to aid label transfer onto said article.

20. An apparatus according to claim 19 wherein said means communicating with respective valve ports and with respective areas where the leading edge of a label is positioned includes a plurality of leading edge plenums which are open to the drum surface and including orifice plates covering each of said leading edge plenums.

21. An apparatus according to claim 19 including a second radially extending, slotted vacuum manifold spaced offset from said first manifolds and extending circumferentially past said article wrapping position, means for creating a vacuum within said second vacuum manifold, a plurality of evenly spaced trailing edge valve ports and midportion engaging valve ports positioned on the inner surface of said drum and aligned circumferentially with said second vacuum manifold, means positioned within said drum and communicating with respective trailing edge and midportion engaging valve ports and with the surface of said drum at respective areas where the trailing edges and midportions of labels are positioned.

22. An apparatus according to claim 21 wherein said means positioned within said drum and communicating with respective trailing edge and midportion engaging valve ports and with respective surfaces of the drum includes trailing and midportion plenums which are open to the drum surface and including orifice plates covering each of said plenums.

23. An apparatus according to claim 21 including a third radially extending slotted vacuum drag manifold spaced offset from said first and second vacuum manifolds and extending circumferentially from a position where said first and second vacuum manifold begin a peripheral distance less than the distance of said first vacuum manifold to define a drag area where the strip of label material is initially supplied to the drum surface, and a plurality of drag valve ports positioned on the inner surface of said drum and aligned circumferentially with said vacuum drag manifold, a plurality of drag plenums within said drum and communicating with the respective drag valve ports and with respective surfaces of said drum at those areas corresponding to where the leading edge portions of labels are positioned so as to drag label film initially supplied to the surface of the drum and align the strip for label cutting as the drum rotates.

* * * * *